US008763779B2

(12) United States Patent
Nireki

(10) Patent No.: US 8,763,779 B2
(45) Date of Patent: Jul. 1, 2014

(54) BILL PROCESSING APPARATUS

(75) Inventor: Takao Nireki, Tokyo (JP)

(73) Assignee: Universal Entertainment Corporation, Koto-ku, Tokyo (JP)

( * ) Notice: Subject to any disclaimer, the term of this patent is extended or adjusted under 35 U.S.C. 154(b) by 876 days.

(21) Appl. No.: 12/255,970

(22) Filed: Oct. 22, 2008

(65) Prior Publication Data

US 2009/0107798 A1 Apr. 30, 2009

(30) Foreign Application Priority Data

Oct. 24, 2007 (JP) ..... 2007-276601
Jun. 13, 2008 (JP) ..... 2008-154989
Jul. 15, 2008 (JP) ..... 2008-183591

(51) Int. Cl.
*G07F 7/04* (2006.01)

(52) U.S. Cl.
USPC ..... 194/206; 271/177; 271/180; 271/182

(58) Field of Classification Search
USPC ..... 194/206, 207; 209/534; 271/177–182
See application file for complete search history.

(56) References Cited

U.S. PATENT DOCUMENTS 6,581,929 B2 * 6/2003 Hiramitsu ..... 271/228
6,994,342 B2 * 2/2006 Ito et al. ..... 271/182
2002/0070496 A1 * 6/2002 Ito et al. ..... 271/177
2004/0217536 A1 * 11/2004 Isobe et al. ..... 271/3.14
2005/0189702 A1 * 9/2005 Takeuchi ..... 271/180
2006/0151281 A1 * 7/2006 Kuroiwa et al. ..... 194/206

FOREIGN PATENT DOCUMENTS

JP 355048112 A * 4/1980 ..... 271/275
JP 405139548 A * 6/1993 ..... B65H 3/04
JP 6-42857 6/1994

OTHER PUBLICATIONS

Derwent Translation of JP405139548A.*
English Translation of JP355048112A.*
U.S. Appl. No. 12/257,899, filed Oct. 24, 2008, Nireki.

* cited by examiner

*Primary Examiner* — Jeffrey Shapiro
(74) *Attorney, Agent, or Firm* — EMP Patent Services, PLLC; Kenneth M. Fagin, Esq.; S. Peter Konzel, Esq.

(57) ABSTRACT

A bill processing apparatus comprises a bill housing part capable of housing a bill therein and a bill conveyance mechanism that conveys the bill to the bill housing part. And in the bill processing apparatus, the bill housing part comprises a receiving port that accepts the bill conveyed by the bill conveyance mechanism and conveyor members which are capable of contacting the bill conveyed-in from the receiving port, and are driven along a conveying-in direction.

13 Claims, 27 Drawing Sheets

BILL PROCESSING APPARATUS

CROSS REFERENCE TO RELATED APPLICATIONS

This application is based upon and claims the benefits of priorities from Japanese Patent Application Nos. 2007-276601, 2008-154989, and 2008-183591 filed on Oct. 24, 2007, Jun. 13, 2008, and Jul. 15, 2008, respectively, the entire contents of which are incorporated herein by reference.

FIELD OF THE INVENTION

The present invention relates to a bill processing apparatus including a bill housing part (e.g., bill stacker) capable of housing bills inserted from a bill insertion slot therein.

RELATED ART

In general, a bill processing apparatus is incorporated into a service providing device, such as a game medium lending machine installed in a game hall, a vending machine or a ticket-vending machine installed in a public space, or the like, that identifies the validity of a bill inserted from a bill insertion slot by a user, and provides various types of products and services in accordance with a value of the bill identified as being valid. Such a bill processing apparatus includes a bill conveyance mechanism that conveys a bill inserted into a bill insertion slot, an operating device such as a bill identification part and the like that judges the validity of the bill (or also called authenticity judgment) to be conveyed, and a control means that drives and controls these operating devices.

Then, bills identified as being valid in the bill identification part are sequentially housed in a bill housing part (or bill container, bill stacker). The bill housing stacker functions as a so-called cashbox that houses a predetermined number of bills, and as disclosed in Patent Document 1, for example, the bill housing stacker is configured to be detachable from a main body part of the bill processing apparatus.

The bill processing apparatus is in a state in which a bill traveling route discharge slot of the apparatus main body and a bill receiving port of the bill housing stacker to be detached are aligned in order to be able to feed bills identified as being valid to the detachable bill housing stacker, and the bills are guided from the bill traveling route of the apparatus main body to the inside of the bill housing stacker, which is, concretely, a pressing process position by a presser plate provided in the bill housing stacker, and thereafter, the bills are sequentially stacked to be housed on a stack part by the presser plate (refer to Utility model application publication No. 06-42857).

SUMMARY OF THE INVENTION

In the present invention, a bill processing apparatus comprises a bill housing part capable of housing a bill therein and a bill conveyance mechanism that conveys the bill to the bill housing part. And in the bill processing apparatus, the bill housing part comprises a receiving port that accepts the bill conveyed by the bill conveyance mechanism and conveyor members which are capable of contacting the bill conveyed-in from the receiving port, and are driven along a conveying-in direction.

Further features of the present invention, its nature, and various advantages will be more apparent from the accompanying drawings and the following description of the preferred embodiment.

DETAILED DESCRIPTION OF THE PREFERRED EMBODIMENT

Hereinafter, embodiments of the present invention will be described with reference to the drawings.

Figure 1:
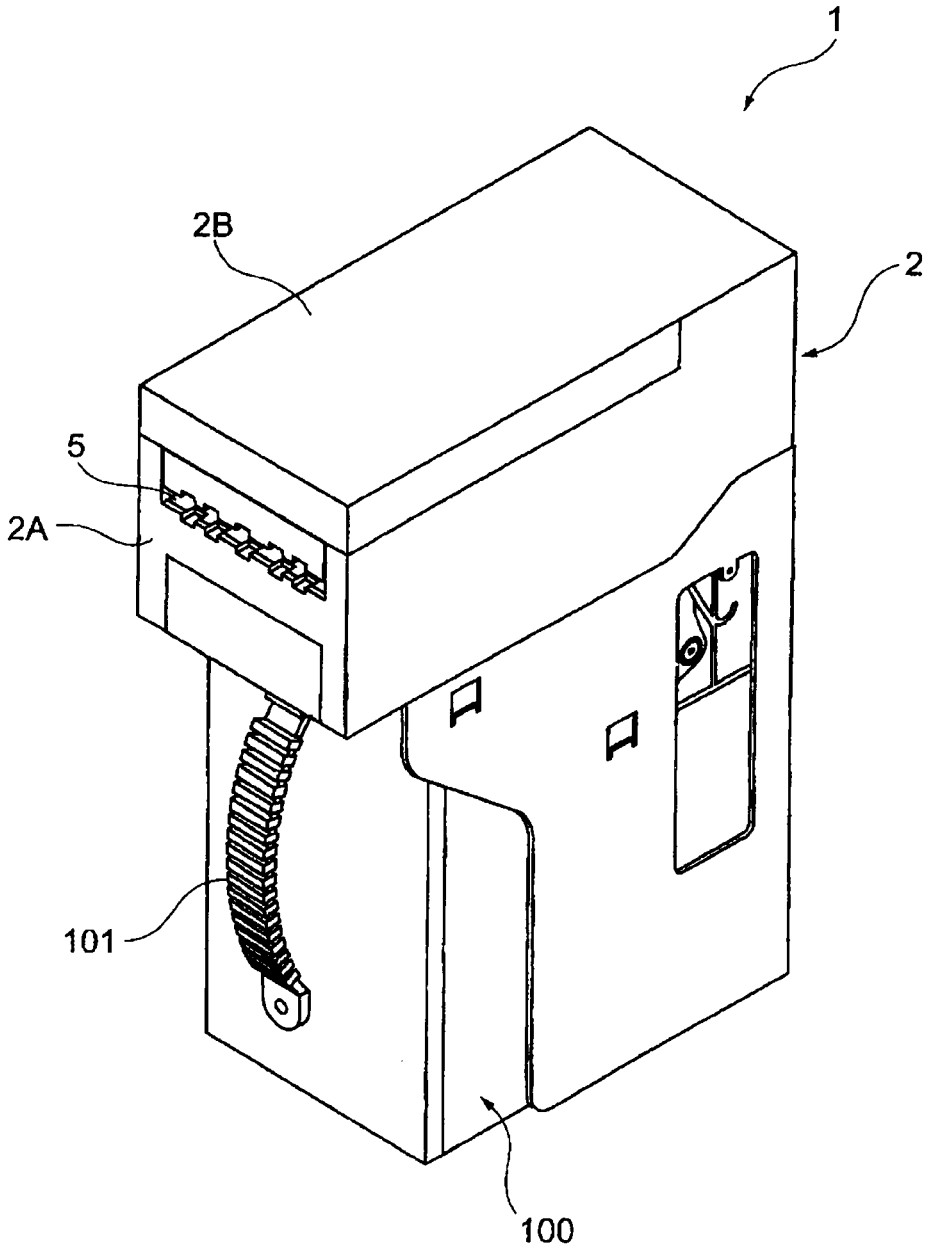
FIG. 1 is a perspective view showing an entire structure to illustrate a configuration of a bill processing apparatus of this embodiment.
Figure 2:
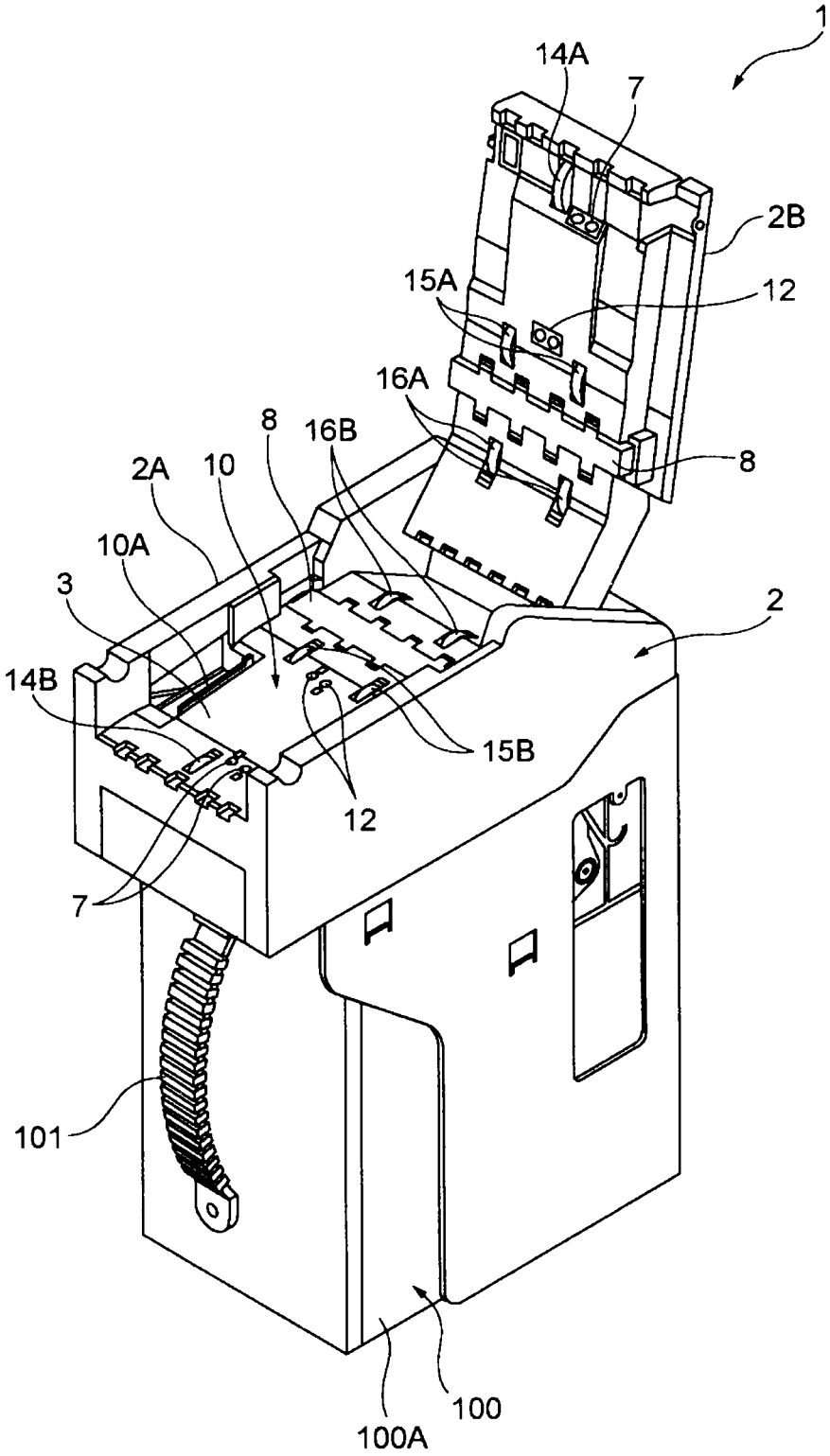
FIG. 2 is a perspective view showing the bill processing apparatus in a state where an open/close member is opened for a main body frame of an apparatus main body.
Figure 3:
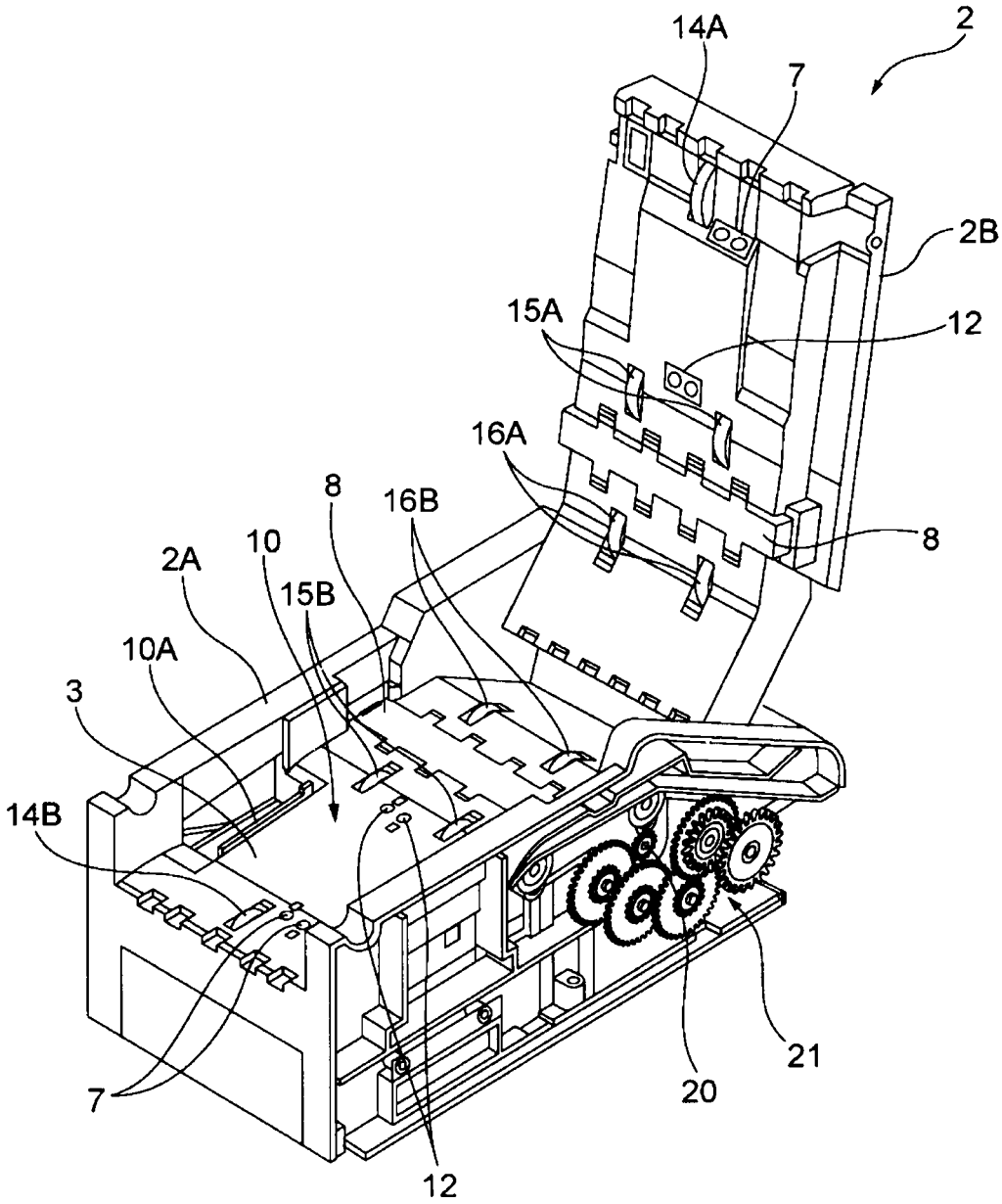
FIG. 3 is a perspective view showing a configuration of a power transmission part of the apparatus main body.
Figure 4:
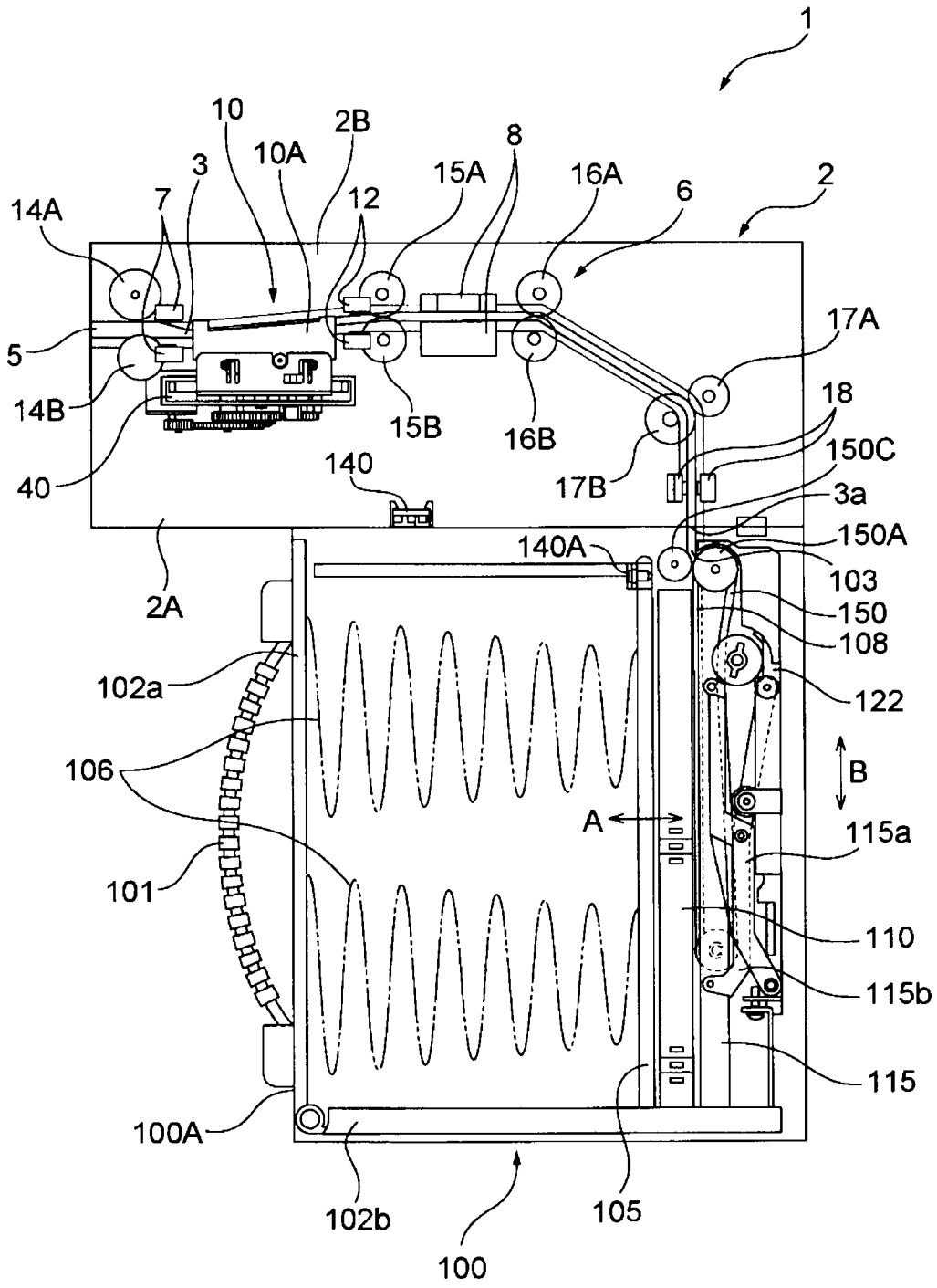
FIG. 4 is a right side view schematically showing a traveling route of a bill to be inserted from an insertion slot.
Figure 5:
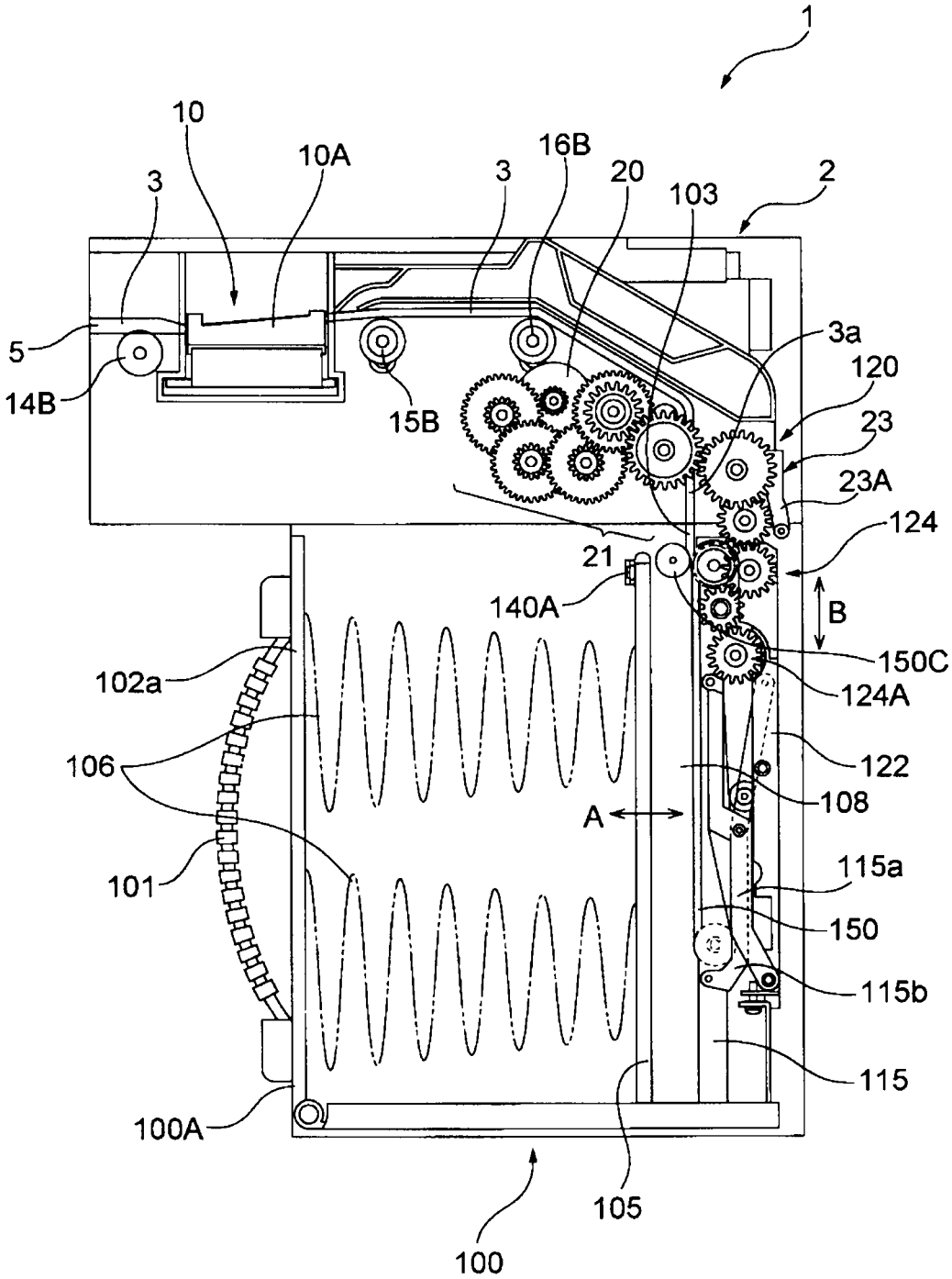
FIG. 5 is a view showing a schematic configuration of a driving force transmission for driving the presser plate arranged in a bill housing part.
Figure 6:
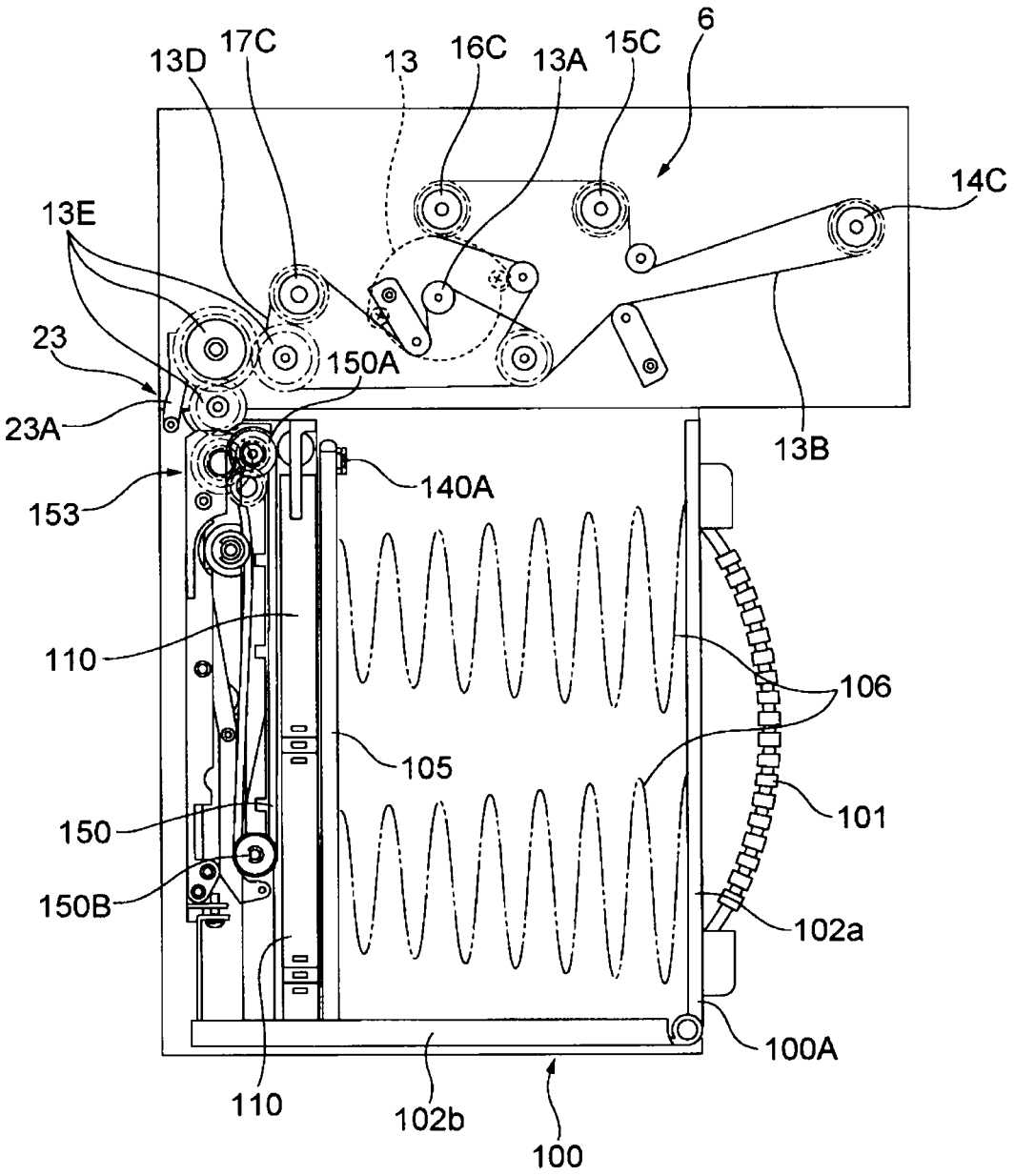
FIG. 6 is a left side view showing a schematic configuration of a driving source and a driving force transmission mechanism to drive a bill conveyance mechanism.

FIGS. 1 to 6 are diagrams showing the configuration of a bill processing apparatus according to the present embodiment. FIG. 1 is a perspective view showing a general configuration thereof, FIG. 2 is a perspective view showing a state in which an open/close member is opened for a main body frame of an apparatus main body, FIG. 3 is a perspective view showing a configuration of a power transmission part of the apparatus main body, FIG. 4 is a right side view schematically showing a traveling route of a bill inserted from an insertion slot, FIG. 5 is a view showing the schematic configuration of a power transmission mechanism to drive a presser plate disposed in a bill housing part, and FIG. 6 is a left side view showing the schematic configuration of a driving source and a driving force transmission mechanism to drive a bill conveyance mechanism.

A bill processing apparatus 1 of the present embodiment is configured to be incorporable into various types of gaming machines such as slot machines, and the bill processing apparatus 1 includes an apparatus main body 2 and a bill housing part (or bill stacker) 100 which is provided to the apparatus main body 2, and is capable of stacking and housing a great number of bills. The bill housing part 100 functions as a cashbox, and may be detachable from the apparatus main body 2, and in the present embodiment, for example, in a state in which a lock mechanism (not shown) is released, the bill housing part 100 can be detached from the apparatus main body 2 by pulling a handle 101 provided to the front face thereof.

As shown in FIGS. 2 and 3, the apparatus main body 2 comprises a main body frame 2A and an open/close member 2B configured to be opened and closed with its one end as a rotating center with respect to the main body frame 2A. Then, as shown in FIG. 4, the main body frame 2A and the open/close member 2B are configured to form a space (bill traveling route) 3 through which a bill is conveyed in an interface where the main body frame 2A and the open/close member 2B are opposing against each other when the open/close member 2B is closed with respect to the main body frame 2A, and to form a bill insertion slot 5 so as to communicate with and correspond to the bill traveling route 3 on the front face which is an exposed side of the main body frame 2A and the open/close member 2B. In addition, the bill insertion slot 5 is a slit-like opening from which a short side edge of a bill can be inserted into the inside of the apparatus main body 2.

In the apparatus main body 2, a bill conveyance mechanism 6 that conveys a bill, an insertion detecting sensor 7 that detects the bill inserted into the bill insertion slot 5, a bill reading means (or device) 8 which is installed on a downstream side of the insertion detecting sensor 7, and reads information from the bill in a carrying sate, a skew correction mechanism 10 that accurately positions and conveys the bill with respect to the bill reading means 8, a movable piece passage detecting sensor 12 that detects that the bill passes through movable pieces that configure the skew correction mechanism 10, a discharge detecting sensor 18 that detects that the bill is discharged into the bill housing part 100, a rack detecting means 23 (refer to FIG. 15) for detecting a position of a rack that drives a presser plate pressing the bill toward a placing plate in the bill housing part 100, and control means (or device) 200 (a control circuit board 200A; refer to FIG. 16) for controlling the driving of the bill conveyance mechanism 6, the bill reading means 8, and the skew correction mechanism 10 are provided.

Hereinafter, the respective components described above will be described in detail.

The bill traveling route 3 is extended substantially horizontally from the bill insertion slot 5 toward the back side (inwardly), and is formed to be bent so as to incline downward on the back side and to be finally bent in the vertical direction. A discharge slot 3*a* from which the bill is discharged into the bill housing part 100 is formed in the bill traveling route 3, and the bill discharged therefrom is fed into a feed port (receiving port) 103 of the bill housing part 100 in the vertical direction.

The bill conveyance mechanism 6 is a mechanism capable of conveying a bill inserted from the bill insertion slot 5 along the insertion direction, and of feedback-conveying (or conveying backward) the inserted bill toward the bill insertion slot 5. The bill conveyance mechanism 6 includes a motor 13 (refer to FIG. 6) serving as a driving source installed in the apparatus main body 2, and pairs of conveyor rollers (14A and 14B), (15A and 15B), (16A and 16B), and (17A and 17B) which are installed side by side for each pair and arranged across the bill traveling route 3 with predetermined intervals along the bill traveling direction, and are driven to rotate by the motor 13.

The pairs of conveyor rollers are installed so as to be partially exposed on the bill traveling route 3. And conveyor rollers 14B, 15B, 16B, and 17B arranged on the lower side of the bill traveling route 3 are driving rollers driven by the motor while conveyor rollers 14A, 15A, 16A, and 17A arranged on the upper side of the bill traveling route 3 are pinch rollers. Here, the pair of conveyor rollers (14A and 14B) that first holds (or nips) therebetween and conveys a bill inserted from the bill insertion slot 5 toward the back side is, as shown in FIGS. 2 and 3, installed at the center position of the bill traveling route 3 such that the upper conveyor roller 14A and the lower conveyor roller 14B can meet in the middle of the bill traveling route 3. Three pairs of conveyor rollers (15A and 15B), (16A and 16B), and (17A and 17B) are installed side by side for each pair (i.e., at two positions across the bill traveling route 3 by a predetermined distance), respectively, on the downstream therefrom in this order.

Further, the above-described pair of conveyor rollers (14A and 14B) disposed in the vicinity of the bill insertion slot 5 are normally in a state where the upper conveyor roller 14A is spaced from the lower conveyor roller 14B, and when insertion of a bill is detected by the insertion detecting sensor 7, the upper conveyor roller 14A is driven to move downwardly toward the lower conveyor roller 14B to hold (or nip) the inserted bill therebetween. Here, the upper conveyor roller 14A is driven to move close to or apart from the lower conveyor roller 14B by a driving source 70 (refer to a block diagram of FIG. 16). The driving source 70 may comprise a motor, solenoid, and the like, and is installed in the open/close member 2B.

Then, when a process (skew correction process) for positioning the bill with respect to the bill reading means 8 (e.g., a bill reading device) by eliminating tilt of the inserted bill (i.e., aligning the bill) is executed by the skew correction mechanism 10, the upper conveyor roller 14A is spaced from the lower conveyor roller 14B so as to release the load on the bill, and when the skew correction process is completed, the upper conveyor roller 14A is driven to move toward the lower conveyor roller 14B again to hold (or nip) the bill therebetween. The skew correction mechanism 10 includes a pair of right and left movable pieces 10A (only one side is shown) that contact and/or squeeze the bill on the sides to eliminate skew, and a motor 40 for a skew driving mechanism is driven to perform the skew correction process.

The conveyor rollers 14B, 15B, 16B, and 17B installed on the underside of the above-described bill traveling route 3 are, as shown in FIG. 6, driven to rotate by the motor 13 and pulleys 14C, 15C, 16C, and 17C installed at the respective ends of the driving shafts of the respective conveyor rollers. That is, a driving pulley 13A is installed to the output shaft of the motor 13, and a driving belt 13B is wrapped around among the pulleys 14C, 15C, 16C, and 17C installed at the ends of the driving shafts of the above-described respective conveyor rollers such that the driving belt 13B is engaged with the driving pulley 13A. Here, a tension pulley is also engaged with the driving belt 13B in order to prevent the belt from loosening.

With the above-described configuration, the motor 13 is driven to rotate normally such that the conveyor rollers 14B, 15B, 16B, and 17B are driven to rotate normally in synchronization therewith to convey the bill in the insertion direction. When the motor 13 is driven to rotate reversely, the conveyor rollers 14B, 15B, 16B, and 17B are driven to rotate reversely in synchronization therewith to convey the bill toward the bill insertion slot 5.

The insertion detecting sensor 7 is to generate a detection signal when a bill inserted into the bill insertion slot 5 is detected. In the present embodiment, the insertion detecting sensor 7 is installed between the pairs of conveyor rollers (14A and 14B) and the skew correction mechanism 10. The insertion detecting sensor 7 is constituted of, for example, an optical sensor such as a regressive reflection photo sensor. However, the insertion detecting sensor 7 may comprise a mechanical sensor other than the optical sensor.

Further, the movable piece passage detecting sensor 12 is to generate a detection signal when it is detected that a leading end of the bill passes through the pair of right and left movable pieces 10A constituting the skew correction mechanism 10, and the movable piece passage detecting sensor 12 is installed on the upstream side of the bill reading means 8. The movable piece passage detecting sensor 12 is also constituted of an optical sensor or a mechanical sensor in the same way as the aforementioned insertion detecting sensor.

Further, the discharge detecting sensor 18 is to detect a back end of the bill passing through such that it is detected that the bill is discharged into the bill housing part 100. The discharge detecting sensor 18 is disposed in front of the receiving port 103 of the bill housing part 100. The discharge detecting sensor 18 also comprises an optical sensor or a mechanical sensor in the same way as the aforementioned insertion detecting sensor.

The bill reading means 8 reads bill information on the bill being conveyed in a state where the skew is corrected (in a state where the bill is accurately positioned) by the skew correction mechanism 10 so as to judge validity (authenticity) thereof. In detail, for example, the bill reading means 8 may be constituted of, for example, a line sensor that performs reading of the bill such that the bill to be conveyed is irradiated with light from the both sides, and transmitted light and reflected light therefrom are detected by a light receiving element. A line sensor is shown in the drawing, and an optical signal read by the line sensor is photoelectric-converted, and the signal is compared and checked with data of a legitimate bill stored in advance, which makes it possible to identify the authenticity of the bill to be conveyed.

The bill housing part 100 that houses bills is configured to be detachable from the apparatus main body 2. Bills identified as genuine or valid by the above-described bill reading means 8 are stacked and contained one after another.

Figure 7:
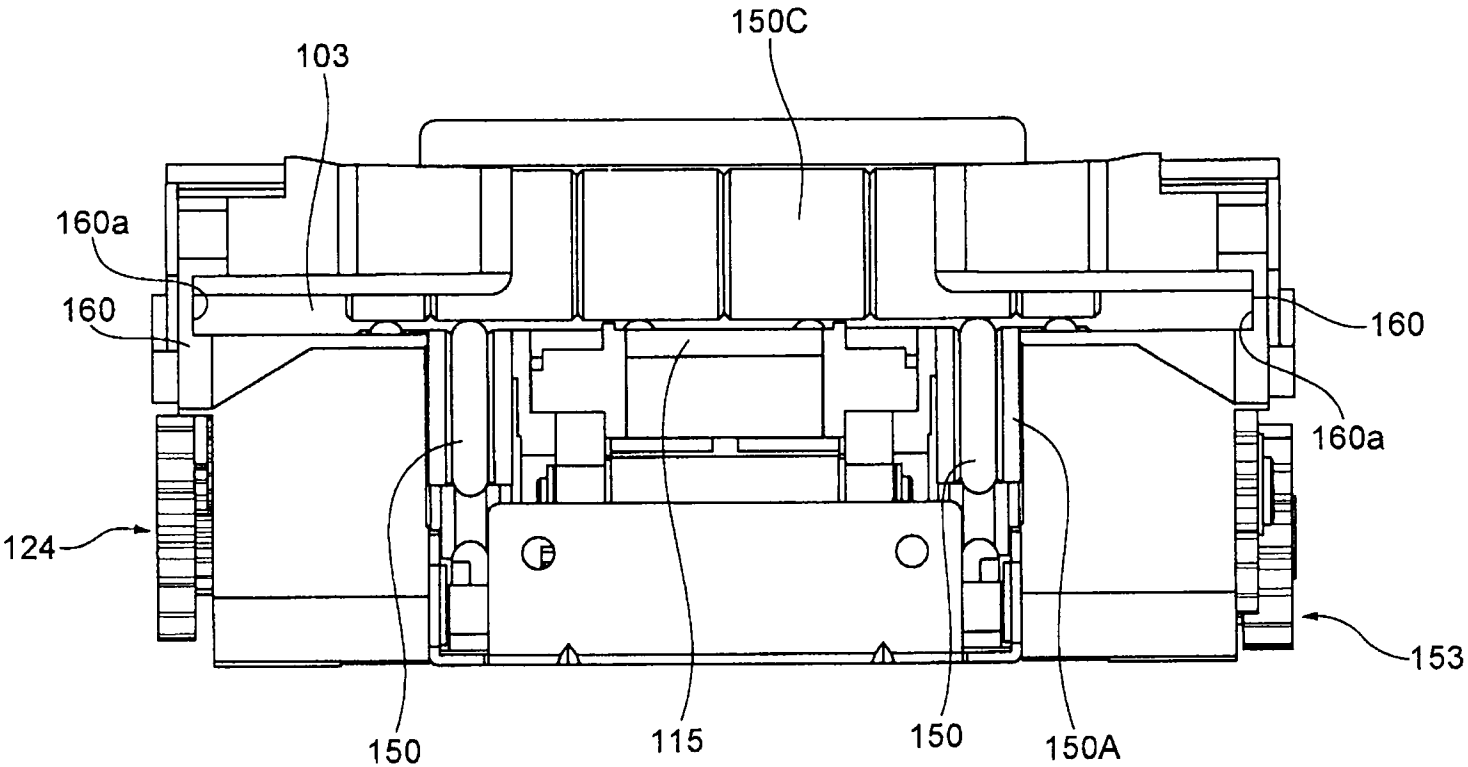
FIG. 7 is a front view showing a receiving port part of the bill housing part.
Figure 8:
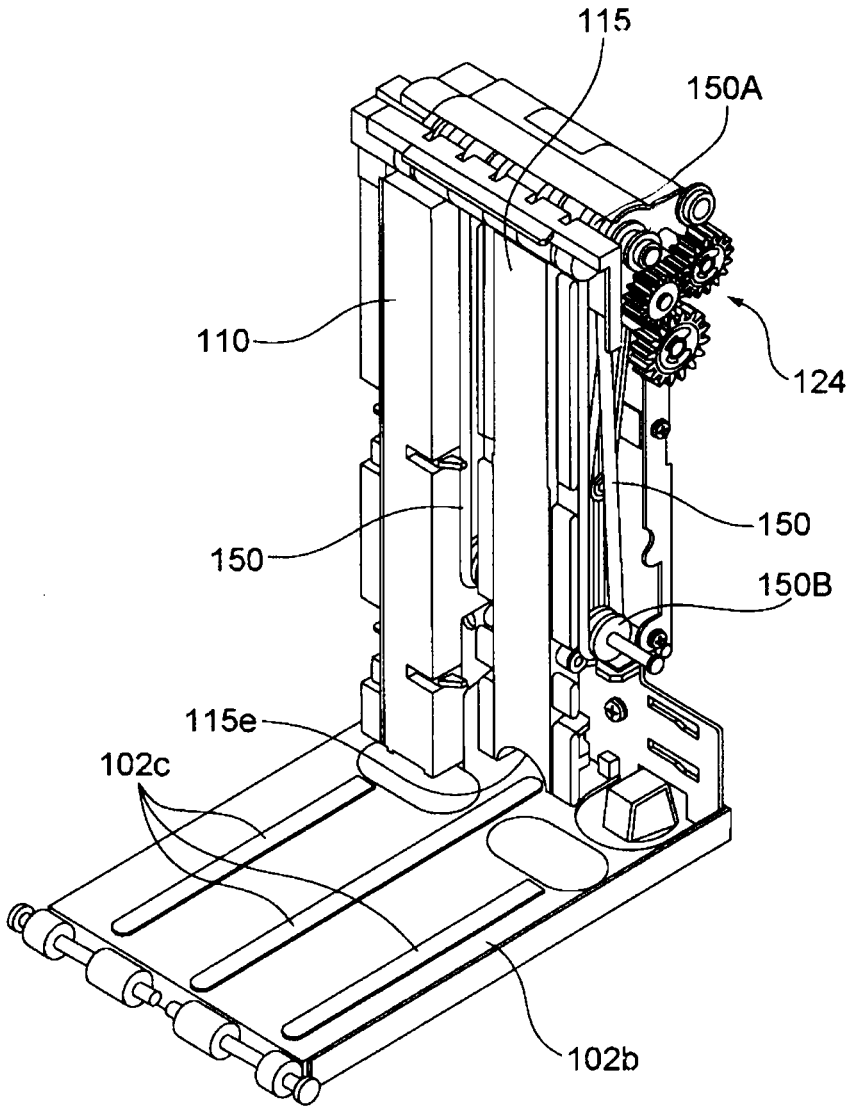
FIG. 8 is a perspective view showing a press holding part and surrounding components that holds a bill conveyed-in from the receiving port for staying there as is (some parts are taken away).
Figure 9:
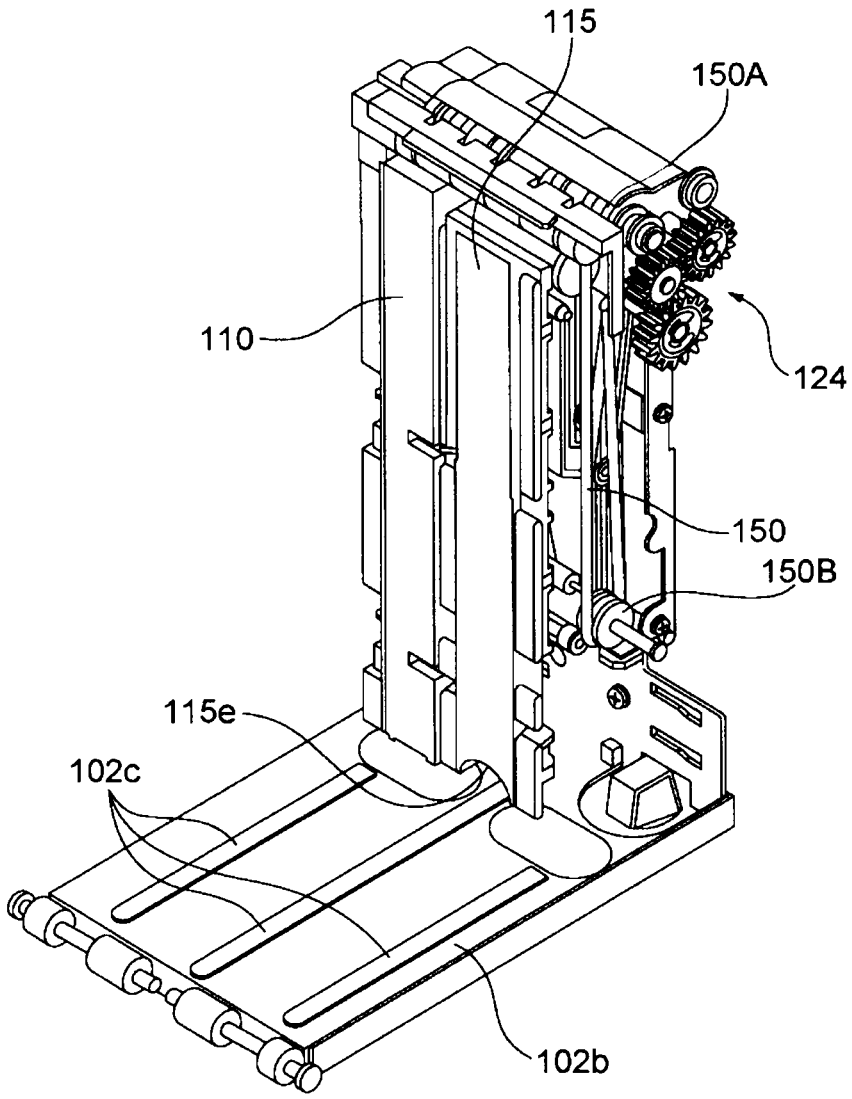
FIG. 9 is a perspective view showing a state in which the presser plate is driven after the state as shown in FIG. 8.
Figure 10:
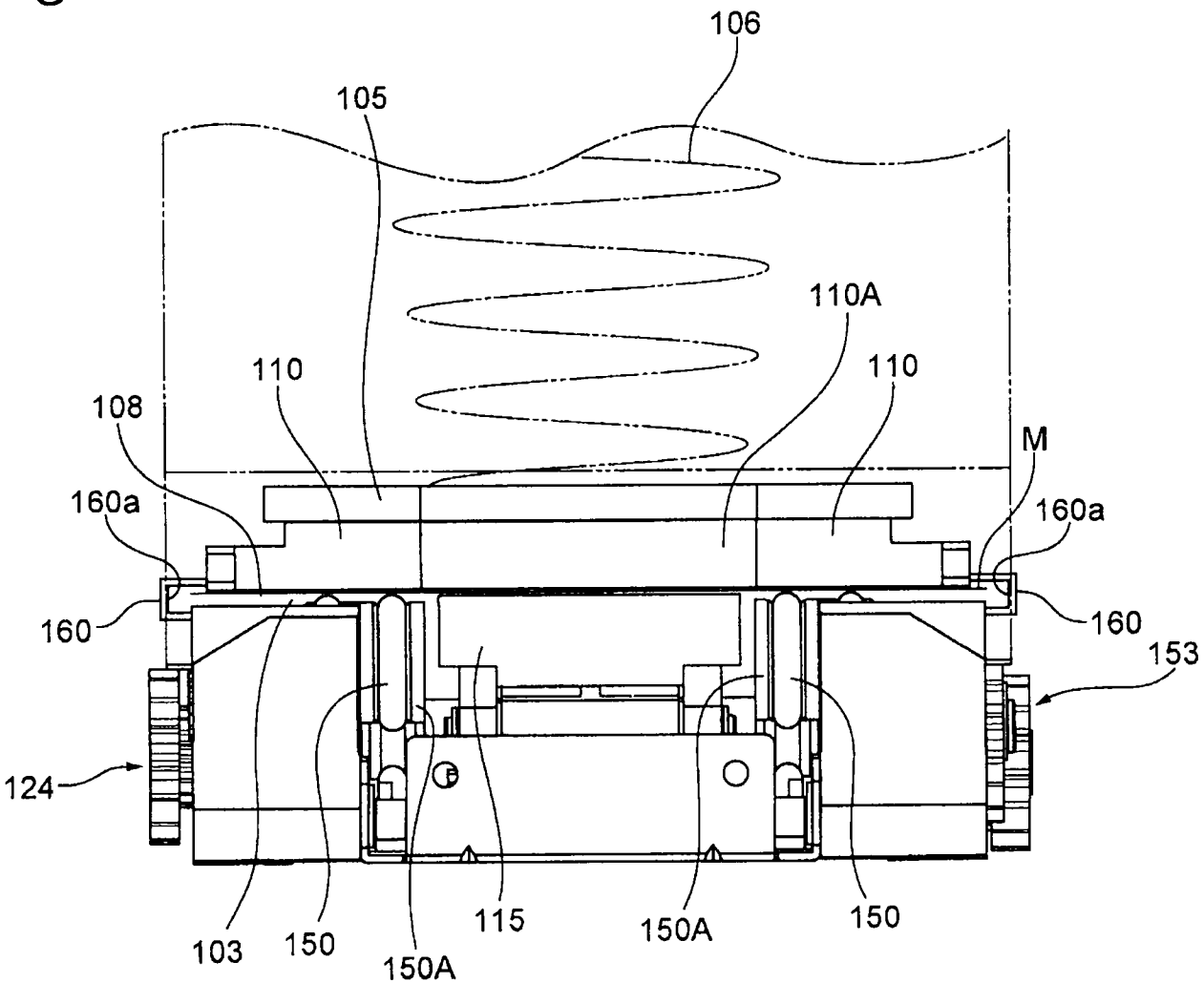
FIG. 10 is a plan view illustrating the receiving port part of a bill housing part when the bill conveyed in from the receiving port stays in a press holding part.
Figure 11:
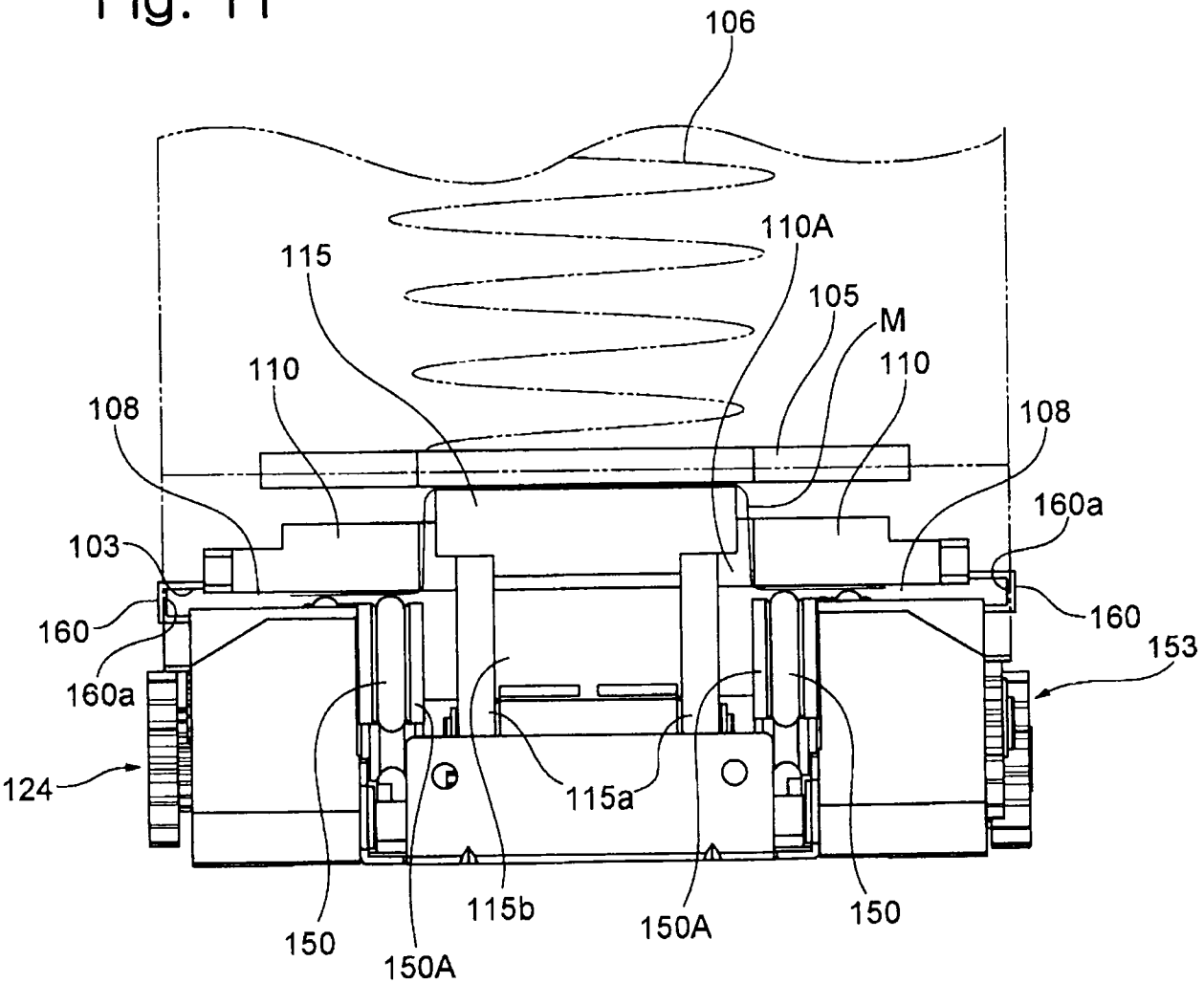
FIG. 11 is a view showing a state in which the presser plate is driven after the state as shown in FIG. 10.
Figure 12:
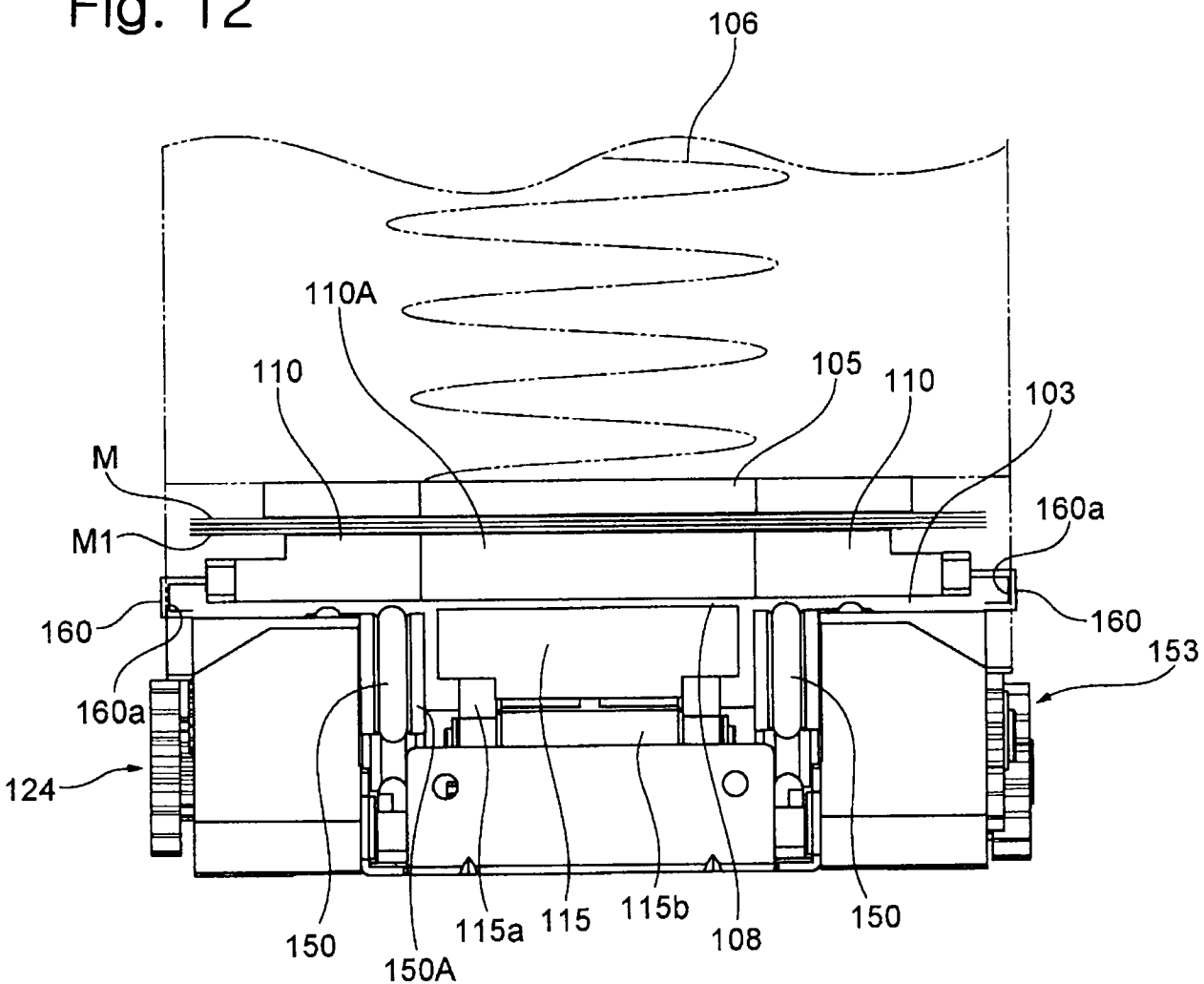
FIG. 12 is a view showing a state in which a plurality of bills are stacked and housed on the placing plate after the state shown in FIG. 11.
Figure 13:
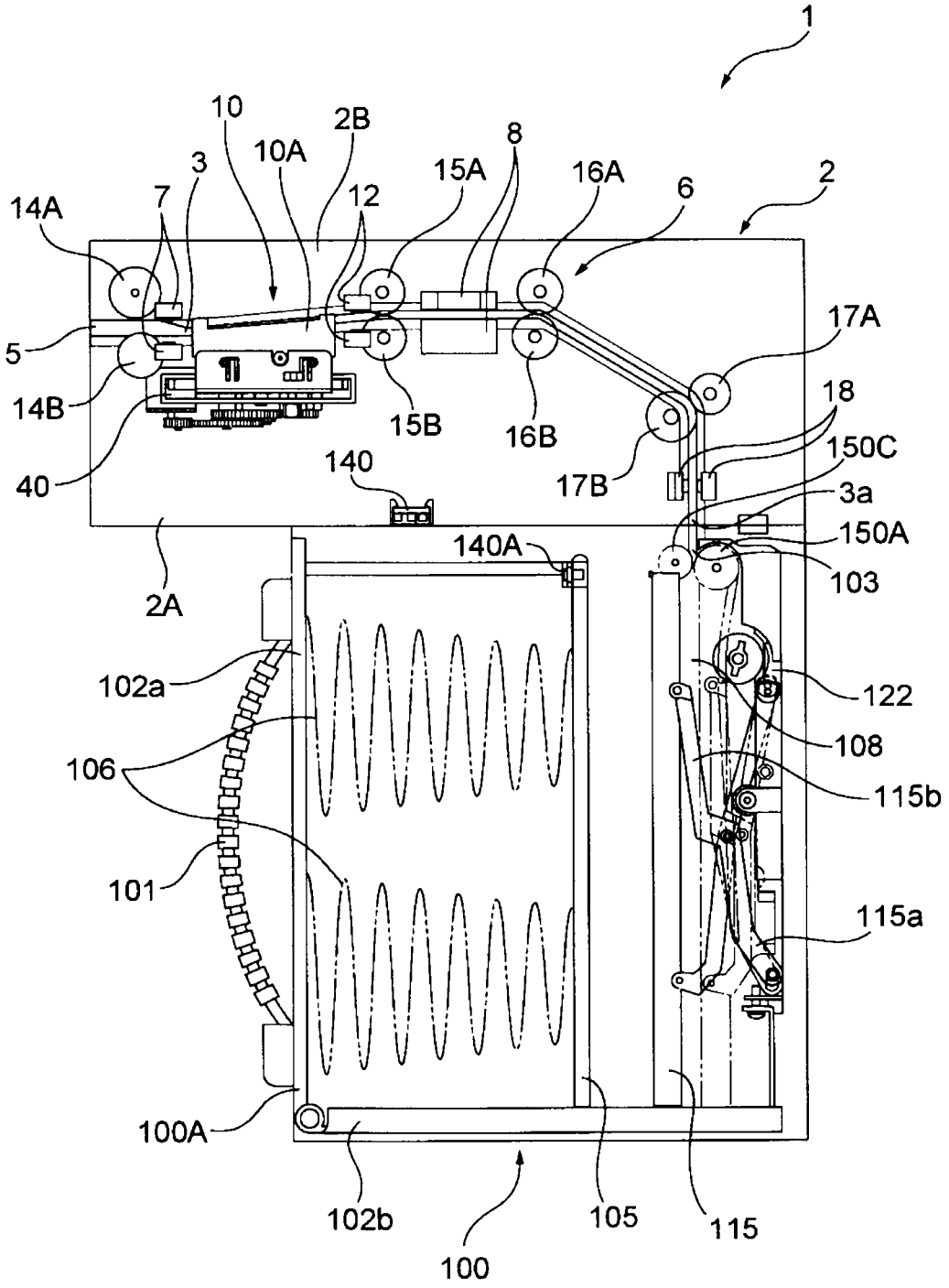
FIG. 13 is a side view showing a state in which the presser plate is at a waiting position.
Figure 14:
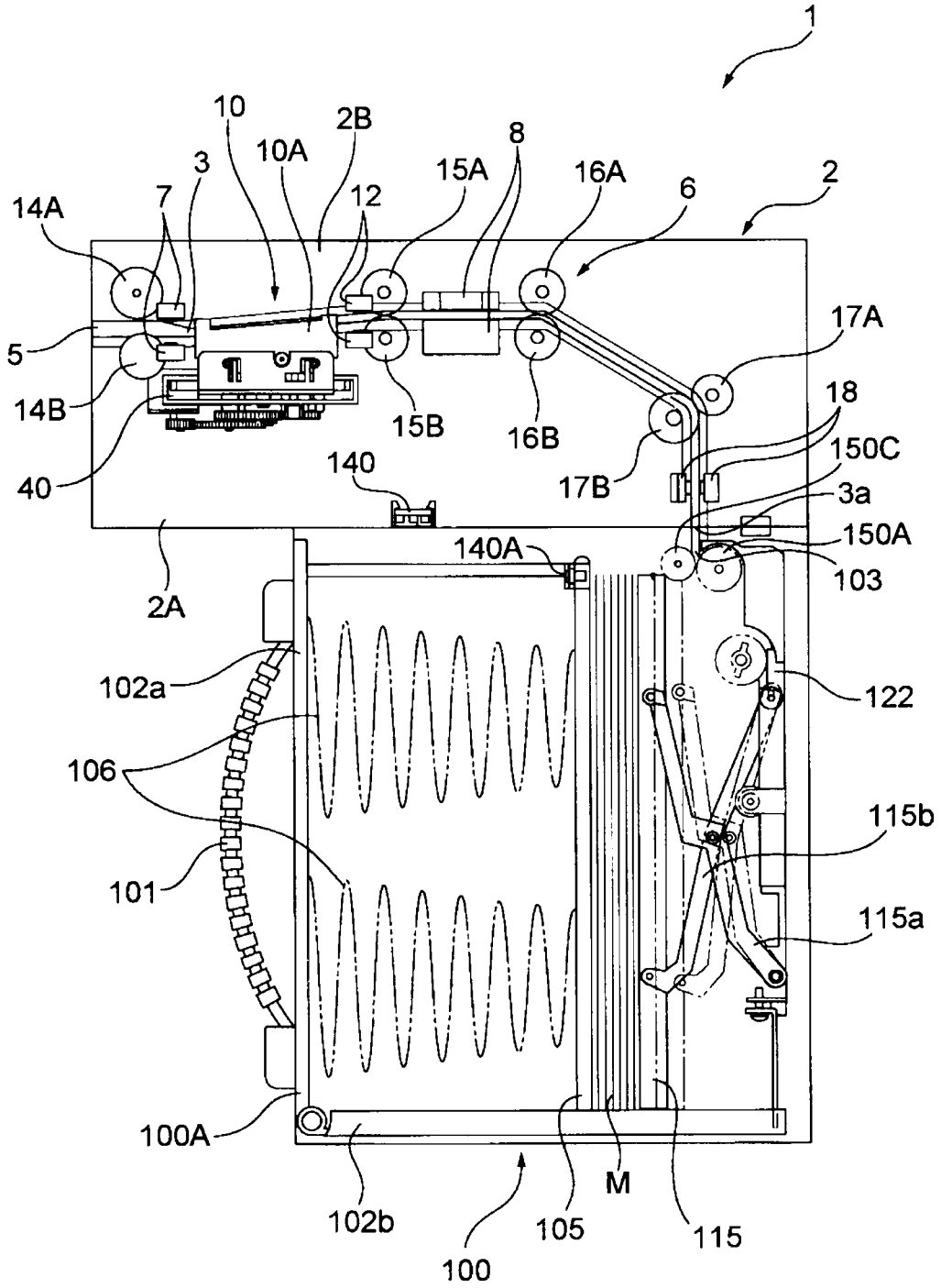
FIG. 14 is a side view showing a state in which the presser plate is at a pressing position.
Figure 15:
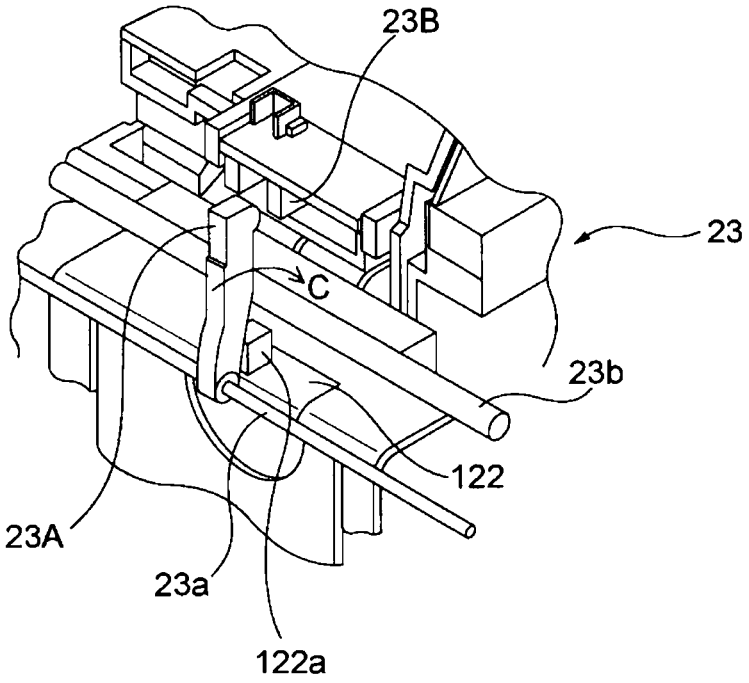
FIG. 15 is a perspective view showing the schematic configuration of a rack detecting means.

Here, the configuration of the bill housing part 100 will be described with reference to FIGS. 7 to 15 in addition to FIGS. 4 to 6. In these figures, FIG. 7 is a plan view showing the receiving port portion of the bill housing part, FIG. 8 is a perspective view showing a press holding part and surrounding components which holds the bill conveyed-in from the receiving port for staying there as it is (some parts are taken away for better illustration), FIG. 9 is a perspective view showing a state in which the presser plate is driven after the state as shown in FIG. 8, FIG. 10 is a plan view illustrating the receiving port portion of the bill housing part, that is a view showing a state in which the bill conveyed-in from the receiving port is located at the press holding part, FIG. 11 is a view showing a state in which the presser plate is driven after the state as shown in FIG. 10, FIG. 12 is a view showing a state in which a plurality of bills are stacked and housed on the placing plate after the state shown in FIG. 11, FIG. 13 is a side view showing a state in which the presser plate is at a waiting position, FIG. 14 is a side view showing a state in which the presser plate is at a pressing position, and FIG. 15 is a perspective view showing the schematic configuration of the rack detecting means.

As shown in FIGS. 4 to 6, the main body frame 100A constituting the bill housing part 100 is formed into a substantially rectangular parallelepiped shape, and one end of bias means (e.g., bias spring) 106 is attached to an interior side of a front wall 102*a* thereof, and a placing plate 105 on which bills to be fed via the above-described receiving port 103 are sequentially stacked is provided to the other end thereof. Therefore, the placing plate 105 is to be pressed toward the presser plate 115 which will be described later by the bias means 106.

In the main body frame 10A, a press holding part 108 that holds a dropping bill as it falls is provided so as to connect a continuing communicating path from the receiving port 103. A pair of regulatory blocks 110 are disposed as their surfaces on the placing plate side extend in the vertical direction on both sides of the press holding part 108, respectively. When bills M are sequentially stacked on the placing plate 105 and the placing plate 105 is pressed by the bias means 106, the pair of regulatory blocks 110 serves as a stopper to thrust the both sides of an uppermost bill M1 to stably hold the bills to be stacked as shown in FIG. 12.

Further, the presser plate 115 that presses bills falling on the press holding part 108 from the receiving port 103 toward the placing plate 105 is installed in the main body frame 10A. As shown in FIG. 10, the presser plate 115 is formed in a size to be capable of passing through a space 110A between the pair of regulatory blocks 110, and gets into the space 110A to be driven to reciprocate between a position at which the bills are pressed against the placing plate 105 (a pressing position; refer to FIGS. 11 and 14) and another position at which the press holding part 108 is opened (an initial position; refer to FIGS. 5 and 10). That is, the bill conveyed into the press holding part 108 from the receiving port 103 passes through the space between the pair of regulatory blocks 110 as the bill is deflected, and is transferred to the placing plate 105 by driving the presser plate 115.

As shown in FIGS. 4 and 5, the presser plate 115 is driven to reciprocate as described above via a presser plate driving mechanism 120 installed in the main body frame 10A. The presser plate driving mechanism 120 includes a pair of link members 115*a* and 115*b*, which have respective end portions supported pivotally by the presser plate 115 and pivotally connected at respective middle portions to form an X-shape, so as to allow the presser plate 115 to be capable of reciprocating in an arrow A direction, and the other end portions of the link members 115*a* and 115*b* are supported pivotally by a movable member 122 installed to be movable in a vertical direction (an arrow B direction). A rack is formed in the movable member 122, and a pinion 124A constituting the presser plate driving mechanism 120 is engaged with the rack.

As shown in FIG. 5, a housing part side gear train 124 constituting the presser plate driving mechanism 120 is connected to the pinion 124A. In this case, in the present embodiment, as shown in FIGS. 3 and 5, a driving source (a motor 20) and a main body side gear train 21 sequentially engaged with the motor 20 are installed in the above-described apparatus main body 2, and when the bill housing part 100 is mounted to the apparatus main body 2, the main body side gear train 21 is to be connected to the housing part side gear train 124. That is, the above-described presser plate 115 is driven to reciprocate in the arrow A direction by the motor 20 provided in the apparatus main body 2 via the presser plate driving mechanism 120 (comprising the link members 115*a* and 115*b*, the movable member 122, and the housing part side gear train 124) and the main body side gear train 21.

Further, when the above-described presser plate 115 is driven to reciprocate in the arrow A direction by the motor 20, the presser plate 115 stops at three positions under the control of stopping the motor 20. That is, the presser plate 115 is capable of stopping at three positions, i.e., at a position where the bill is pressed onto the placing plate 105 (a pressing position) as shown in FIGS. 11 and 14, at another position where the press holding part 108 is open (an initial position) as shown in FIGS. 5 and 10, and at a position where the pair of link members 115*a* and 115*b* that drive the presser plate 115 are located at the press holding part 108 and the bill cannot be conveyed into the press holding part 108 from the receiving port 103 by the pair of link members 115*a* and 115*b* (a waiting position) as shown in FIG. 13, that is, a position for preventing foreign matter and the like from being inserted from the receiving port 103.

In the main body frame 100A, as shown in FIG. 4, a detecting sensor (full detecting sensor) 140 that detects the state when a predetermined number of bills are placed on the placing plate 105 is installed. The full detecting sensor is configured to be capable of detecting a magnetic signal, and is configured to be capable of detecting a magnetic field by a magnet 140A provided on the rear surface of the placing plate 105. That is, the full detecting sensor 140 is installed at a predetermined position in a direction in which the placing plate 105 is pressed back, and when bills are sequentially placed on the placing plate 105 and the placing plate 105 is pressed back even though the bias force of the bias means 106 pushes the placing plate 105, the full detecting sensor 140 detects a backward movement of the placing plate 105 such that the full detecting sensor 140 outputs a signal indicating that the bills on the placing plate 105 are full.

Further, as shown in FIG. 9, the bottom edged of the above-described presser plate 115 abuts on the bottom wall 102*b* of the bill housing part 100 in a condition that at least some portion of the bottom edge does not contact. More specifically, by forming a curved portion 115*e* in an arch shape on the contact side end face (bottom edge) of the presser plate 115, the presser plate 115 is so configured on the contact side end face that the face contact with the bottom wall 102*b* is prevented. In another way of expression, the contact side end of the presser plate 115 and the bottom wall 102*b* are so configured that a contact area therebetween is made smaller.

In such a configuration, since the presser plate 115 has the non-contact portion on the contact side end face with the bottom wall 102*b*, the presser plate 115 is driven to move so as to press the bills onto the placing plate 105, which can effectively prevent the bills from being stuck between the contact side end face and the bottom wall 102*b* and being jammed inside that bill housing part. Here, it is also preferable to form projections 102*c* extending in the stacking direction on the bottom wall 102*b*. Predetermined distances are provided between respective ridge-like projections 102*c* on the on the bottom wall 102*b* in order to prevent the bills to be housed from contacting with the bottom wall all along the edges. That is, provided that the projections 102*c* are formed and that the presser plate 115 is arranged on the on the bottom wall 102*b* such that the projections 102*d* are just below the curved portion (recess) 115*e*, it is possible to more stably stack and house the bills.

Conveyor members 150 which are capable of touching the bill conveyed-in from the receiving port 103 are installed in the main body frame 10A. The conveyor members 150 takes its own role to contact the bill conveyed in so as to stably guide the bill to an appropriate position of the press holding part 108 (a position at which, the bill can be stably pressed with no inclination to the right or left when the bill is pressed by the presser plate 115). In the present embodiment, the conveyor members are constituted of belt-like members (hereinafter called belts 150) installed so as to face the press holding part 108.

In this case, the belts 150 are installed so as to extend along the conveying-in direction with respect to the bill, and are wrapped around the pair of pulleys 150A and 150B supported rotatably on both ends in the conveying-in direction. Further, the belts 150 contact a conveyor roller 150C extending in an axis direction which is supported rotatably in the region of the receiving port 103, and those hold the bill conveyed in the receiving port 103 therebetween to guide the bill directly to the press holding part 108. Here, the pulley 150A is disposed at a position so as to oppose the conveyor roller 150C via the belt 150 and the pulley 150B is disposed at another position apart from and vertically below the pulley 150A by a predetermined interval distance. In this way, the belt wrapped around the pulleys 150A and 150B and the bill having been nipped by the conveyor roller 150C and the belt 150 travel side by side until the bill travels into the press holding part 108. The predetermined distance between the pulleys 150A and 150B may be adjusted such that at least a portion of the bill can contact the belt 150 until the bill, which may be in a variety of size and generally circulated in each country, is completely contained. More specifically, the distance is typically about 50% to 150% of the long edge of the bill having the size of a length from 120 to 163 mm and a width from 58 to 85 mm. Moreover, in the present embodiment, a pair of belts 150 are provided on the right and left sides, respectively, so as to sandwich the above-described presser plate 115 in order to be capable of contacting the surface on left and right sides of the bill.

Here, the regulatory block 110 has an opposing surface with a predetermined distance opposing to a surface of the belt 150, which can be contacted with the bill, such that the opposing surface may help the belt 150 contact the bill on right and left sides. In particular, even if the wrinkled bill is inserted within the predetermined distance, the wrinkled bill may swing or fluctuate so as to hit the opposing surface and be bounced back to the contactable surface of the belt 150 since a wrinkled bill has a so-called effective thickness which is thicker than the non-wrinkled bill. The belt travels in the conveying-in direction such that force in the conveying-in direction may be applied to the bill.

Here, the pair of belts 150 may be prevented from loosening by not only being wrapped around the pulleys 150A and 150B at the both ends, but also causing tension pulleys to push those at the intermediate positions. Further, the pulley 150A may be disposed at a position shifted in an axis direction with respect to the conveyor roller 150C, and the belt 150 wrapped around the pulley 150A may be disposed so as to not contact the conveyor roller 150C. That is, the bill conveyed-in from the receiving port 103 may be made to hold by the conveyor roller 150C and pinch rollers (not shown) installed on the drive shaft of the pulley 150A, and after the bill passes through it, the bill may be made to contact the belts 150 to be guided to the press holding part 108.

The pair of belts 150 are to be driven by the motor 13 that drives the above-described plurality of conveyor rollers installed in the apparatus main body 2. In detail, as shown in FIG. 6, the above-described driving belt 13B driven by the motor 13 is wrapped around a pulley 13D for driving force transmission, and a gear train 153 installed at the end of the spindle of the pulley 150A supported rotatably at the receiving port 103 side engages with a gear train 13E for power transmission sequentially installed to the pulley 13D. That is, when the bill housing part 100 is mounted to the apparatus main body 2, the gear train 153 is to engage with the end gear of the gear train 13E, and the pair of belts 150 are to be driven to rotate integrally with the above-described conveyor rollers 14B, 15B 16B, and 17B for conveying bills by driving the motor 13 to rotate.

In this way, at the time of driving the belts 150 installed in the bill housing part, because the motor 13 serving as the driving source of the bill conveyance mechanism 6 provided in the apparatus main body 2 is utilized, it is possible to reduce the cost.

As shown in FIG. 7, guide members 160 regulating the both side edges of the bill are formed along the conveying-in direction of the bill from the receiving port 103 in the main body frame 10A. The guide members 160 have laterally-facing square U-shaped guide faces 160*a* regulating the both side edges of the bill to be conveyed in, and when the bill is conveyed in the inside of the bill housing part (the press holding part 108) from the receiving port 103, the guide faces 160*a* allow the bill to move along the guide member 160, and the bill and the pair of belts 150 can slidingly contact each other stably. In accordance therewith, an inclination at the time of conveying the bill in the press holding part 108 is corrected, which makes it possible to more reliably convey the bill to an appropriate position.

Moreover, a variable lever 23A constituting the rack detecting means 23 that detects a position of the rack driving the presser plate 115 (a position of the movable member 122 to which the rack is formed) is installed in the main body frame 100A. As shown in FIGS. 5 and 15, the rack detecting means 23 includes an optical sensor element (a rack detecting sensor) 23B provided to the apparatus main body 2 side, and the variable lever 23A installed in the main body frame 100A of the bill housing part 100. As shown in FIG. 15, the variable lever 23A is supported so as to be biased (or pressed) in a direction of rotating in a direction of arrow C with respect to a spindle 23*a*, and so as to be capable of contacting a contact member 122*a* provided to the end of the movable member 122 driven in a direction of arrow B. Further, turning of the variable lever 23A is to be regulated by a regulatory shaft 23*b*.

Then, in the above-described structure, when the movable member 122 moves upward to move the presser plate 115 to the initial position as shown in FIGS. 5 and 10, the contact member 122*a* contacts the variable lever 23A, and the variable lever 23A is turned against the bias force, and the sensor element 23B detects this state (in which the variable lever 23A breaks away from the optical sensor). That is, the rack detecting means 23 detects that the movable member 122 moves upward and the presser plate 115 is located at the initial position.

Figure 16:
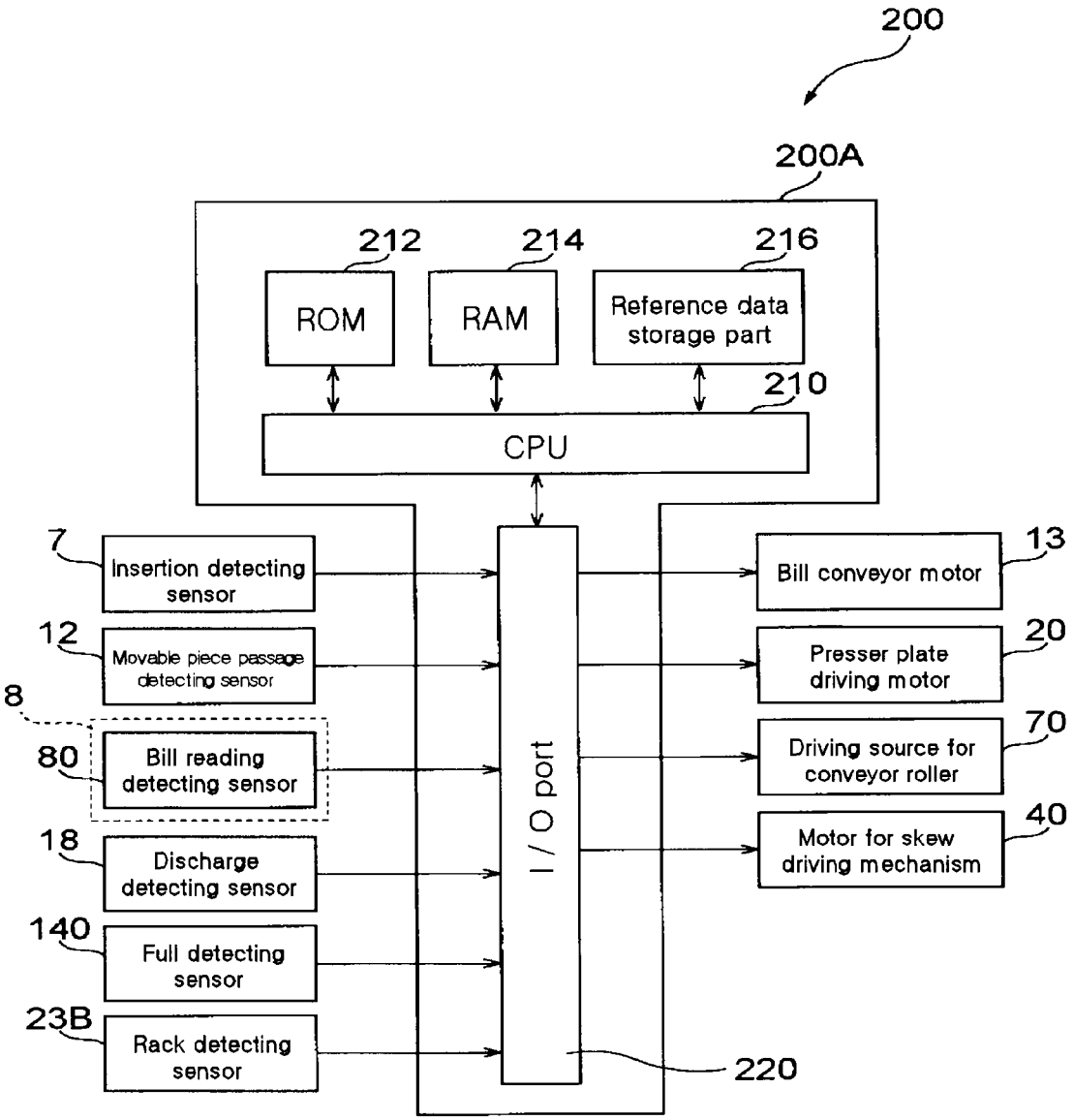
FIG. 16 is a block diagram showing a configuration of control means for controlling drives of a bill conveyance mechanism, bill reading means, and a presser plate and a pair of belts arranged inside a bill housing part.
Figure 17:
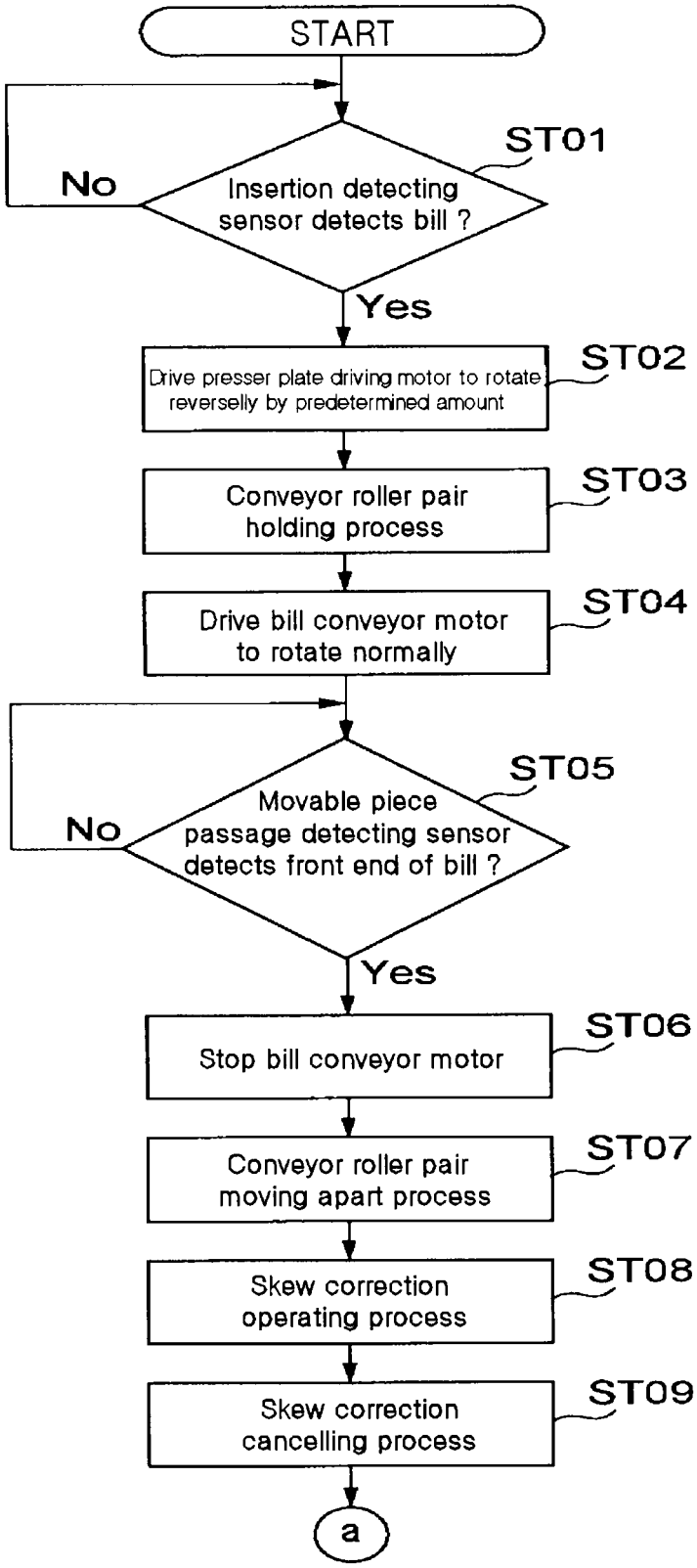
FIG. 17 shows a flowchart (part one) illustrating processing operations for processing a bill in a bill processing apparatus of this embodiment.
Figure 18:
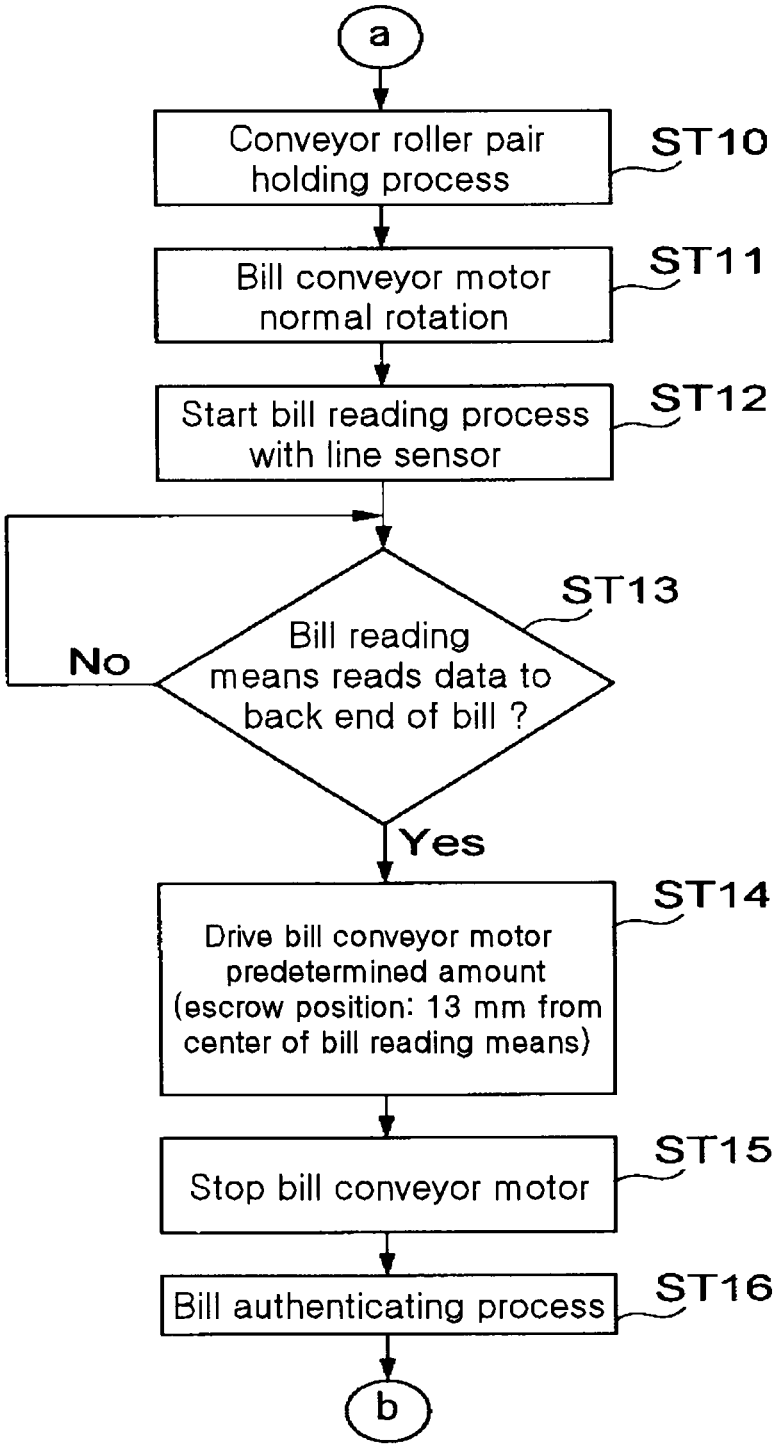
FIG. 18 shows a flowchart (part two) illustrating processing operations for processing a bill in a bill processing apparatus of this embodiment.
Figure 19:
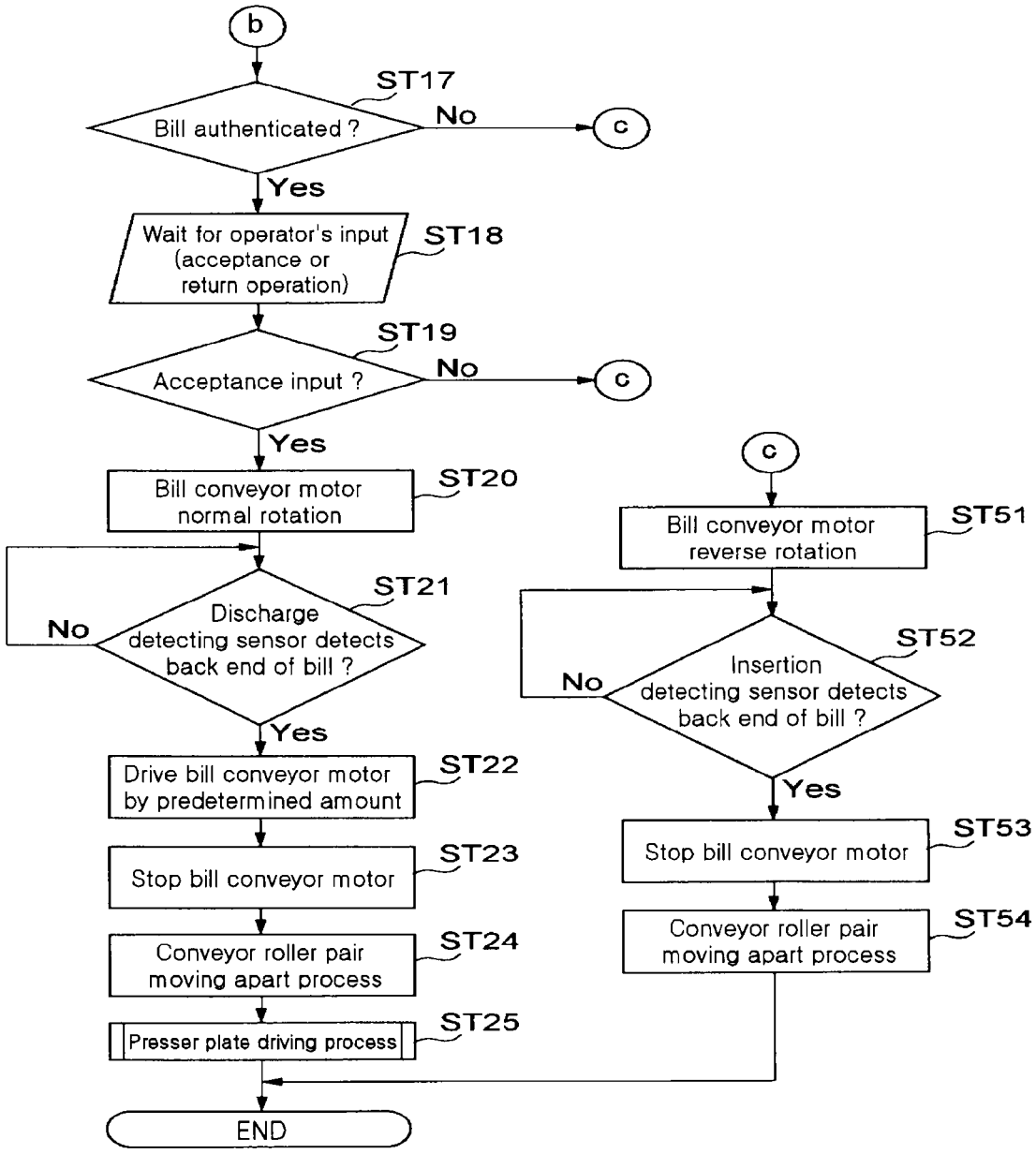
FIG. 19 shows a flowchart (part three) illustrating processing operations for processing a bill in a bill processing apparatus of this embodiment.

Next, as described above, the control means (e.g., control device) for controlling the driving of the bill conveyance mechanism 6, the bill reading means 8, and the presser plate 115 and the pair of belts 150 installed in the bill housing part 100 will be described with reference to FIG. 16.

The control means 200 includes the control circuit board 200A that controls the operations of the above-described respective drive units, and a CPU (Central Processing Unit) 210 configuring bill identification means, a ROM (Read Only Memory) 212, a RAM (Random Access Memory) 214, and a reference data storage part 216 are mounted on the control circuit board.

In the ROM 212, various types of programs such as operation programs for the respective drive units such as the motor 13 that drives the bill conveyance mechanism, the motor 20 that drives the presser plate, the driving source 70 that drives the conveyor roller 14A to get in contact with or become apart from the conveyor roller 14B, and the motor 40 to drive the skew driving mechanism 10, an authenticity judgment program for bills read by the bill reading means 8, and permanent data are stored. The CPU 210 generates control signals according to the programs stored in the ROM 212, and carries out input and output of the signals with respect to the above-described respective drive units via an I/O port 220, to control the driving of the respective drive units.

Further, detection signals from the insertion detecting sensor 7, the movable piece passage detecting sensor 12, the discharge detecting sensor 18, the full detecting sensor 140, and the rack detecting sensor 23B are to be input to the CPU 210 via the I/O port 220, and the driving of the respective drive units is controlled on the basis of these detection signals.

Further, data and programs used for operating the CPU 210 are stored in the RAM 214, and reference data used for performing a bill authenticity judgment, for example, various types of data acquired from all the printing areas in a legitimate bill (such as data on contrasting density and data on a transmitted light or a reflected light when a bill is irradiated with infrared rays) are stored as reference data in the reference data storage part 216. Note that the reference data are stored in the dedicated reference data storage part 216. However, the data may be stored in the ROM 212.

Then, a bill reading detection sensor (for example, a line sensor) 80 that configures the above-described bill reading means 8 is connected to the CPU 210 via the I/O port 220, and bill reading data read by the bill reading detection sensor 80 are compared with the reference data stored in the reference data storage part 216, which allows a bill authenticity judgment process to be executed.

Here, the above-described control means 200 that controls the operation of the bill processing apparatus is mounted on one control circuit board 200A. However, the control means 200 may be disposed in a dispersive manner on separate control circuit boards depending on its functions.

Next, the bill processing operation in the bill processing apparatus 1 executed by the above-described control means 200 will be described according to the flowcharts of FIGS. 17 to 20.

When an operator inserts a bill into the bill insertion slot 5, the pair of conveyor rollers (14A and 14B) installed in the vicinity of the bill insertion slot are in a state in which the rollers are spaced from each other as in an initial state (refer to ST24 and ST54 which will be described later). Further, with respect to the presser plate 115, as shown in FIG. 13, the pair of link members 115*a* and 115*b* driving the presser plate 115 are located at the press holding part 108, and the presser plate 115 is positioned at the waiting position at which the bill cannot be conveyed-in the press holding part 108 from the receiving port 103 by the pair of link members 115*a* and 115*b* (refer to ST67 which will be described later).

In the initial state of the above-described pair of conveyor rollers (14A and 14B), it is possible for the operator to easily insert even a bill having wrinkles into the bill insertion slot 5. Then, when insertion of the bill is detected by the insertion detecting sensor 7 (ST01), the driving motor 20 of the above-described presser plate 115 is driven to rotate reversely by a predetermined amount (ST02) to move the presser plate 115 to the initial position. At this initial position, the press holding part 108 is in an open state (refer to FIGS. 5 and 10), and the bill can be conveyed in the inside of the bill housing part.

Further, the above-described driving source 70 is driven to move the upper conveyor roller 14A to contact the lower conveyor roller 14B. In accordance therewith, the inserted bill is held between the pair of conveyor rollers (14A and 14B) (ST03).

Next, the bill conveyor motor 13 is driven to rotate normally (ST04). The bill is conveyed into the inside of the apparatus by the pair of conveyor rollers (14A and 14B), and when the movable piece passage detecting sensor 12 installed on the downstream side from the skew correction mechanism 10 detects the leading end of the bill, the bill conveyor motor is stopped (ST05 and ST06). At this time, the bill is located between the pair of movable pieces 10A constituting the skew correction mechanism 10.

Next, the above-described driving source 70 is driven to allow the pair of conveyor rollers (14A and 14B) to hold (or nip) the bill therebetween to be spaced from each other (ST07). At this time, the bill is in a state where no load is applied.

Then, a skew correction operating process is executed in this state (ST08). This skew correction operating process is achieved such that the above-described motor 40 for the skew correction mechanism is driven to rotate normally to drive the pair of movable pieces 10A closer to each other. That is, the bill is moved so as to be aligned in the center direction by the movable pieces 10A contacting on the both sides, and its skew is eliminated thereby, which positions the bill so as to be at an accurate center position.

When the skew correction operating process as described above is completed, next, a skew correction canceling process is executed (ST09). This process is achieved such that the above-described motor 40 for the skew correction mechanism is driven to rotate reversely to move the pair of movable pieces 10A toward the directions in which the both are spaced from each other.

Next, the above-described driving source 70 is driven to move the upper conveyor roller 14A to contact the lower conveyor roller 14B, and the bill is held between the pair of conveyor rollers (14A and 14B) (ST10). Thereafter, the bill conveyor motor 13 is driven to rotate normally to convey the bill toward the inside of the apparatus, and when the bill passes through the bill reading means 8, a bill reading process is executed (ST11 and ST12).

Then, when the bill to be conveyed passes through the bill reading means 8, and the data up to the back end of the bill is read, the bill conveyor motor 13 is driven by a predetermined amount to stop the bill at a predetermined position (an escrow position; a position at which the bill is conveyed toward the downstream by 13 mm from the center position of the bill reading means 8), and at this time, a bill authenticity judgment process is executed in the control means 200 (ST13 to ST16).

In the bill authenticity judgment process at ST16 as described above, when the bill is judged as a legitimate bill (ST17; Yes), an input from the operator is accepted (ST18). This input corresponds to an acceptance operation in which the operator presses an acceptance button in order to accept provision of service (for example, an acceptance process according to the start of a game in a case of a gaming unit), and a process in which the operator presses a return button in order to execute a process for returning the inserted bill.

Then, when an operation to accept the provision of various types of services is input (ST19; Yes), the bill conveyor motor 13 is driven to rotate normally to convey the bill toward the bill housing part 100 (ST20). At the time of conveying the bill, the bill conveyor motor 13 is driven to rotate normally until the back end of the bill is detected by the discharge detecting sensor 18 (ST21), and after the back end of the bill is detected by the discharge detecting sensor 18, the bill conveyor motor 13 is driven to rotate normally by the predetermined amount (ST22 and ST23).

The process for driving the bill conveyor motor 13 to rotate normally at ST22 and ST23 corresponds to a driving quantity by which the bill is conveyed in the receiving port 103 of the bill housing part 100 from the discharge slot 3*a* on the downstream side of the bill traveling route 3 of the apparatus main body 2, and the pair of belts 150 contact the surface on both sides of the conveyed-in bill, and the bill is stably guided to the press holding part 108. That is, when the bill conveyor motor 13 is further driven to rotate normally by a predetermined amount after the back end of the bill is detected by the discharge detecting sensor 18, the pair of belts 150 contact the bill conveyed-in from the receiving port 103 to be driven in the bill feeding direction, to guide the bill in a stable state to the press holding part 108.

In this case, since the bill is guided along the guide faces 160*a* of the guide members 160 formed along the bill conveying-in direction from the receiving port 103, when the bill is conveyed in the press holding part 108, the bill is to be conveyed to the appropriate pressing position with no inclination in combination with the contact with the pair of belts 150. In detail, for example, even if the bill conveyed-in from the receiving port 103 has wrinkles and the like, which brings a possibility that the bill does not move up to (or does not fall on) a predetermined position in the press holding part 108, the pair of belts 150 in a conveying state contact the bill, which makes a conveyor effect work on the bill, such that the bill can be moved to the predetermined appropriate position. Then, after the bill is moved to the appropriate position, as will be described later, the presser plate 115 makes a pressing effect act on the bill, and the bill passes through the space 110A between the pair of regulatory blocks 110 so as to be symmetrically deflected, and a pressing process (a housing process) is achieved thereon.

Further, as described above, because the bill contacts the pair of belts 150, it is possible to stably guide the bill to the appropriate position regardless of the installation state of the bill processing apparatus. That is, in a case in which the bill processing apparatus 1 obliquely is mounted to another device for example, even when a bill passes through the end conveyor roller pair in the apparatus main body, the bill may not be guided to a pressing position accurately, or when the bill has many wrinkles, those may become resistance when the bill is conveyed in the press holding part 108 regardless of the mounting state of the bill processing apparatus, which brings a possibility that the bill cannot be guided to the pressing position accurately in the same way. However, provided that the pair of belts 150 as described above is installed, it is possible to stably convey the bill to the appropriate pressing position.

Here, since the conveyor members are constituted of the belts 150, it is impossible to draw out the bill from the receiving port 103 even if the belts are made to rotate reversely for illicit purposes or the like.

Then, after the above-described bill conveyor motor 13 is stopped, the above-described driving source 70 is driven to cause the pair of conveyor rollers (14A and 14B) to be spaced therebetween (ST24), and the process for driving the presser plate 115 is executed (ST25) in order to place the bill on the placing plate 105.

Figure 20:
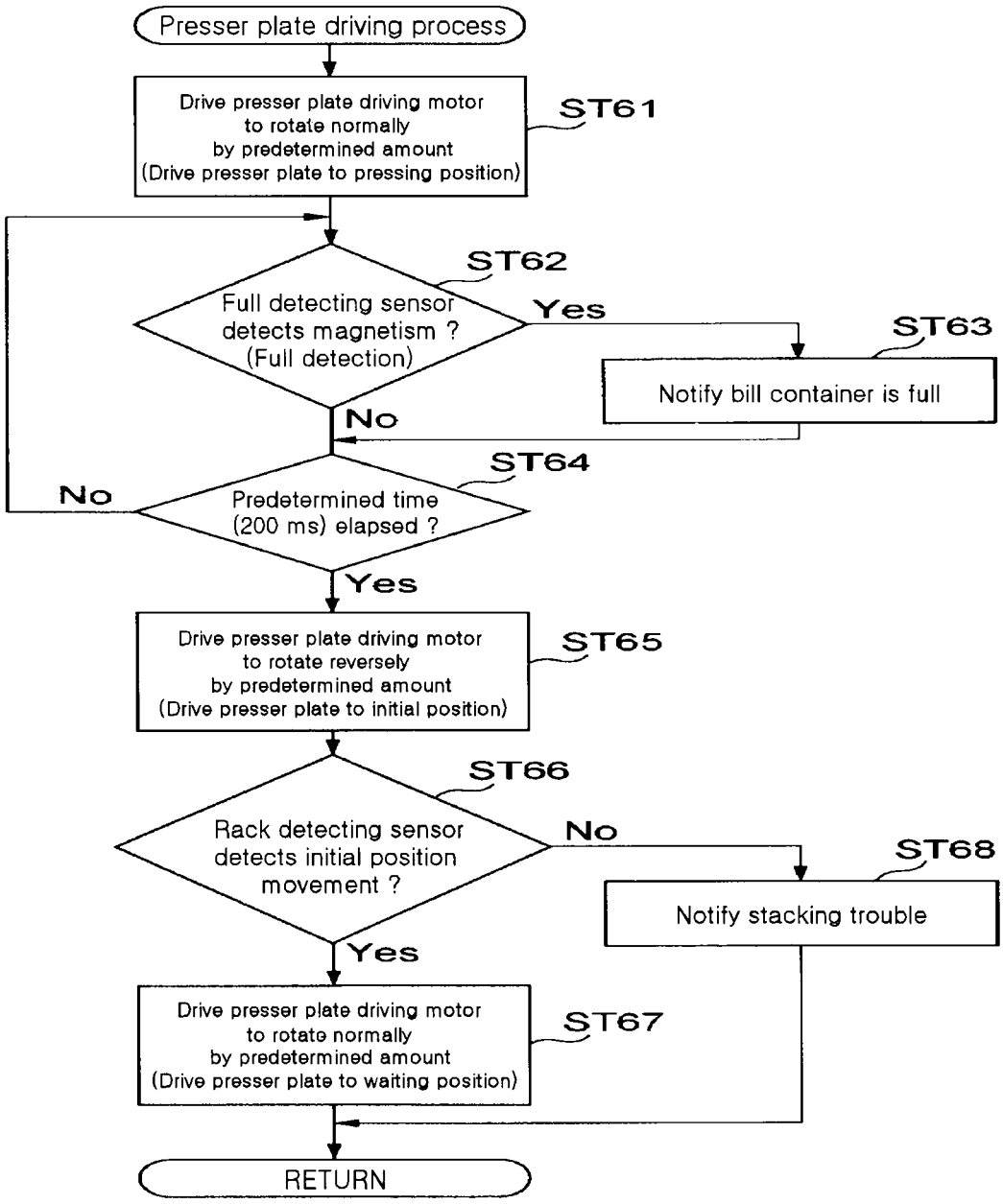
FIG. 20 shows a flowchart illustrating processing operations of a driving process of a presser plate.

The process for driving the presser plate 115 is executed in accordance with the flowchart shown in FIG. 20.

First, the driving motor 20 of the presser plate 115 is driven to rotate normally by a predetermine amount to move the presser plate 115 at the initial position to the pressing position (ST61). According to the movement of the presser plate 115, as shown in FIGS. 10 and 11, the bill at the press holding part 108 passes through the space 110A between the pair of regulatory blocks 110 so as to be symmetrically deflected in a U-shape, and the bill is finally pressed onto the placing plate 105. At this time, because the bill is conveyed to the appropriate pressing position with no inclination by the pair of belts 150 as described above, even when the presser plate 115 moves, the bill is placed on the placing plate 105 stably without causing jamming or the like between the presser plate 115 and the pair of regulatory blocks 110.

Further, as described above, because the presser plate 115 contacts the bottom wall 102*b* of the bill housing part 100 so as to have the non-contact portion as shown in FIG. 8, even when the presser plate 115 is driven as shown in FIG. 9, it is prevented that the bills are stuck between the presser plate 115 and the bottom wall 102*b*, which makes it possible to effectively prevent the bills from being jammed inside the bill housing part. Here, in this state, when the above-described full detecting sensor 140 detects the magnetism from the rear surface of the placing plate 105 (ST62; Yes), it is informed that the bill housing part is full (ST63).

The movement of the presser plate 115 to the pressing position described above is executed during a predetermined time (200 ms) so as to place the bill stably on the placing plate 105 (ST64), and thereafter, the driving motor 20 of the presser plate 115 is driven to rotate reversely by a predetermined amount to return the presser plate 115 to the initial position (ST65).

At this time, if the above-described rack detecting sensor 23B detects a movement of the rack (the movable member 122) to the initial position (ST66; Yes), the driving motor 20 of the presser plate 115 is driven to rotate normally by a predetermined amount to move the presser plate 115 at the initial position to the waiting position as shown in FIG. 13 (ST67). At this waiting position, the receiving port 103 is in a closed condition, and even if an attempt is made to insert foreign matter and the like from the receiving port 103 for illicit purposes, for example, it is possible to reliably prevent such an action because the pair of link members 115*a* and 115*b* come to block the press holding part 108. Here, in a case in which the rack detecting sensor 23B does not detect a movement of the rack (the movable member 122) to the initial position (ST66; No), an abnormality in a stack operation is informed (ST68).

Further, at ST17 in the procedure of the processes described above, when the bill is not judged as a legitimate bill, or when the return button is pressed down by the operator (ST19; No), the bill conveyor motor 13 is driven to rotate reversely, to convey the bill waiting at the escrow position toward the bill insertion slot 5 (ST51). Then, when the insertion detecting sensor 7 detects the back end of the bill to be returned toward the bill insertion slot 5, the above-described driving to rotate the bill conveyor motor 13 reversely is stopped, and the driving source 70 is driven to allow the pair of conveyor rollers (14A and 14B) holding the bill therebetween to be spaced from each other (ST52 to ST54), and the series of processes is completed.

Next, another embodiment of the present invention will be described.

Figure 21:
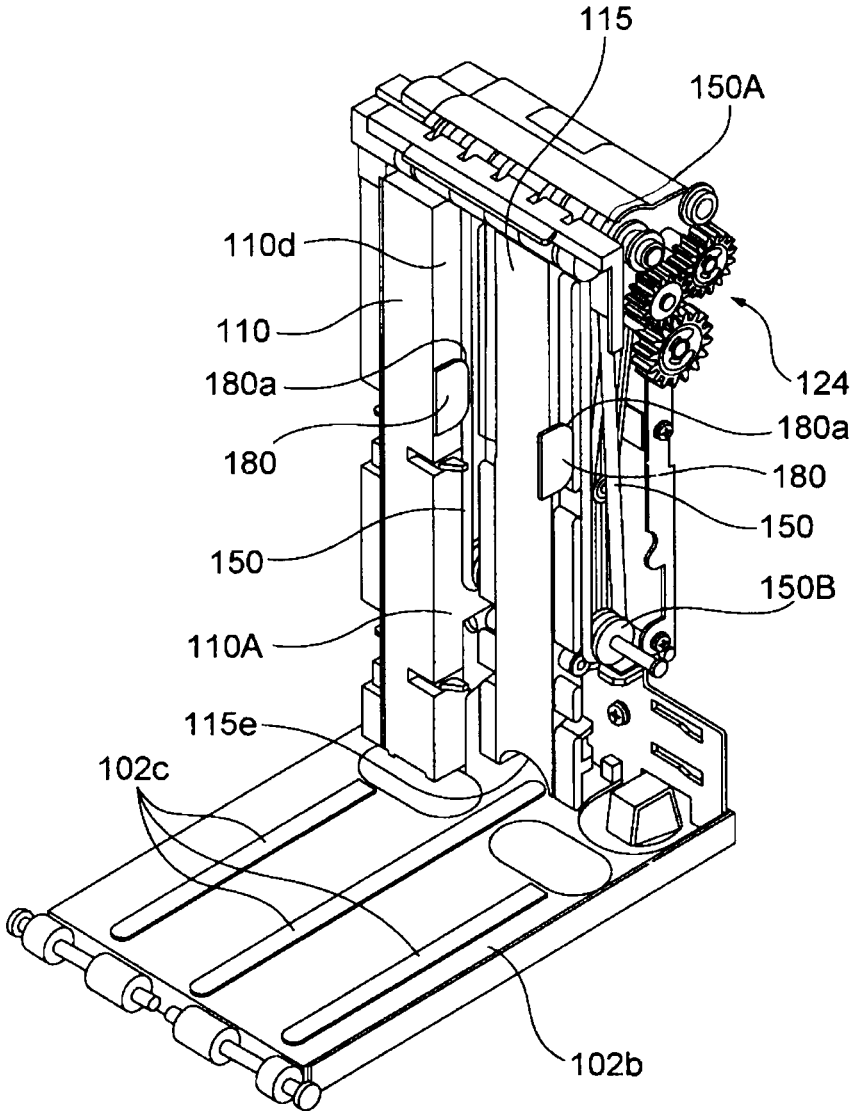
FIG. 21 is a perspective view of a press holding part and surrounding components that holds the bill conveyed-in from the receiving port to stay there as is (some parts are taken away) for showing a second embodiment of the present invention.
Figure 22:
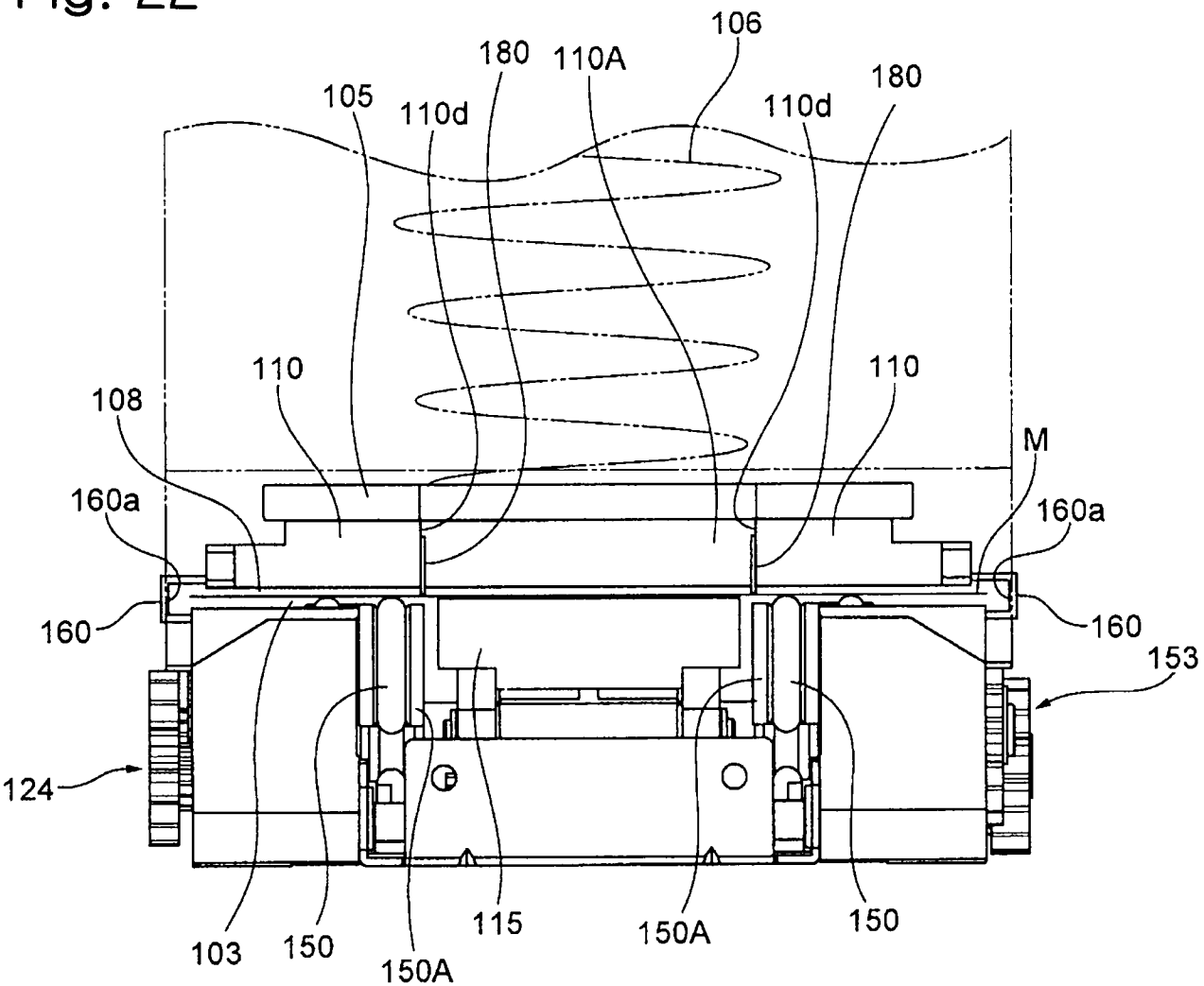
FIG. 22 is a plan view showing the receiving port part of the bill housing part in the configuration as shown in FIG. 21 and showing a state in which the bill conveyed-in from the receiving port is located at the press holding part.
Figure 23:
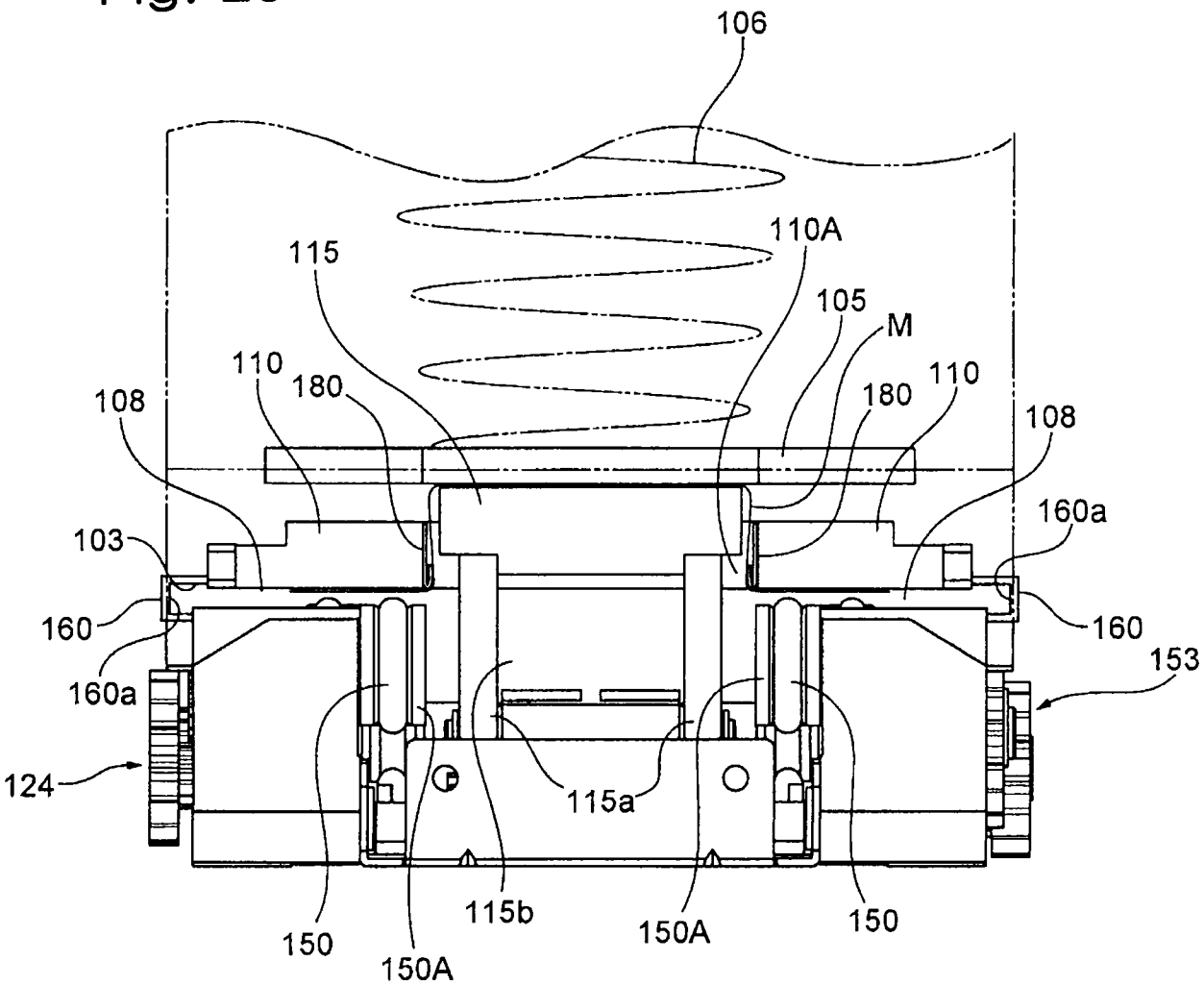
FIG. 23 is a view showing a state in which the presser plate is driven after the state as shown in FIG. 22.

FIGS. 21 to 23 are diagrams showing a second embodiment of the present invention. FIG. 21 is a perspective view of the press holding part and surrounding components that holds the bill conveyed-in from the receiving port to stay (shown partially cut out) as it is, FIG. 22 is a plan view showing the receiving port portion of the bill housing part in the structure shown in FIG. 21, and a view showing a state in which the bill conveyed-in from the receiving port is located at the press holding part, and FIG. 23 is a view showing a state in which the presser plate is driven in the state shown in FIG. 22.

The bill processing apparatus used for the above-described embodiment may be configured to be universally compatible so as to be capable of processing bills in various sizes. More specifically, the bill processing apparatus may be configured to be capable of housing bills, for example, in sizes of a length from 120 to 163 mm or so and a width from 58 to 85 mm or so in the bill housing part (or cashbox) 100. Therefore, the bill housing part 100 is designed such that a distance between the conveyor roller 150C installed therein and the bottom face of the bill housing part (the bottom wall 102*b* or the projection 102*c*) is made longer to some extent than 163 mm which is the maximum length of the bills to be inserted (163+α mm).

However, if the bill housing part 100 is designed so as to have the length as described above, when a bill with a short length (a bill with a length of 120 mm in the above-described example) is used, a distance from the point at which the bill passes through the conveyor roller 150C up to the bottom face, within which the bill is in a free state, is made long. Therefore, the bill easily becomes unstable in contacting by only the above-described pair of belts 150, which easily generates skew in the free state. Further, additionally, in a case of a bill with a narrow width, when the bill is transferred to the press holding part 108, the edge positions thereof may be shifted in the space 110A of the pair of regulatory blocks 110, and when the presser plate 115 is driven to press the bill in this state, trouble in housing may be brought about.

Therefore, in the second embodiment, as will be hereinafter described in detail, the apparatus is configured to allow the bill passing through the conveyor roller 150C to be capable of reliably contacting the pair of belts 150. That is, the apparatus is configured to cause the bill passing through the conveyor roller 150C to shift to the pair of belts 150 side to contact it reliably.

For example, protrusions 180 protruding toward the respective belts 150 are provided to the opposite side of the respective belts (conveyor members) 150 across the bill to be conveyed-in from the receiving port 103, in detail, the opposite faces (inner faces specifying the space 110A) 110*d* of the pair of regulatory blocks 110 forming the bill housing part.

In this case, because the protrusions 180 are attached to the opposite faces 110*d* of the pair of regulatory blocks 110 between which the bill passes through as described above, the protrusions 180 may be formed of a deformable plate-like member, in detail, a material which is a thin plate-like member and is elastically deformable, for example, a polyester film, or a Mylar® PET film (manufactured by DuPont). That is, the protrusions 180 have a plate-like shape along a direction perpendicular to the conveying-in direction of the bill, and the protrusions 180 are configured to touch the bill to be elastically deformable when the bill is transferred to the direction perpendicular to the conveying-in direction from the receiving port 103 (the direction of the placing plate 105).

Further, it is preferable that circular arc portions 180*a* are formed so as to gradually shift the bill in the belt direction along the conveying-in direction of the bill at the portions of the protrusions 180 which the bill to be conveyed in contacts first.

Provided that the protrusions 180 as described above are provided, it is possible to reliably shift the bill conveyed in via the receiving port 103 toward the belts 150 in a driving state, and it is possible to cause the bill to touch the belts 150 stably. That is, even if a bill with a short length and a narrow width is inserted in the apparatus, it is possible to reliably convey the bill along the belts 150, and it is possible to reliably prevent the occurrence of skew or an inclination in the press holding part 180. In particular, the protrusions 180 are formed into a plate-like shape, even if load is applied thereto by the bill conveyed-in from the receiving port 103, strength to an extent that the protrusions themselves are not deformed along the conveying direction can be provided, which makes it possible to shift the bill to the belt side to reliably touch the belts 150.

That is, regardless of a size in a longitudinal direction and a width direction of the bill, and its state (the presence of wrinkles) of the bill, an inclination of the bill to be conveyed-in via the receiving port 103 can be reliably corrected, which makes it possible to guide the bill to the appropriate position of the press holding part 108.

Then, a pressing effect by the presser plate 115 is made on the bill guided to the appropriate position of the press holding part 108, and as shown in FIG. 23, the bill passes through the space 110A between the pair of the regulatory blocks 110 so as to be symmetrically deflected, and a pressing process (a housing process) is achieved thereon. Note that, when the bill passes through the space 110A so as to be symmetrically deflected, because the protrusions 180 are configured to be elastically deformable as described above, the protrusions 180 are deformed so as to be bent according to the passage of the bill, and after the bill passes through it, the protrusions 180 return to the state shown in FIGS. 21 and 22. That is, because the protrusions are deformed when the bill is transferred toward the placing plate 105, damage to the bill is alleviated.

Figure 24:
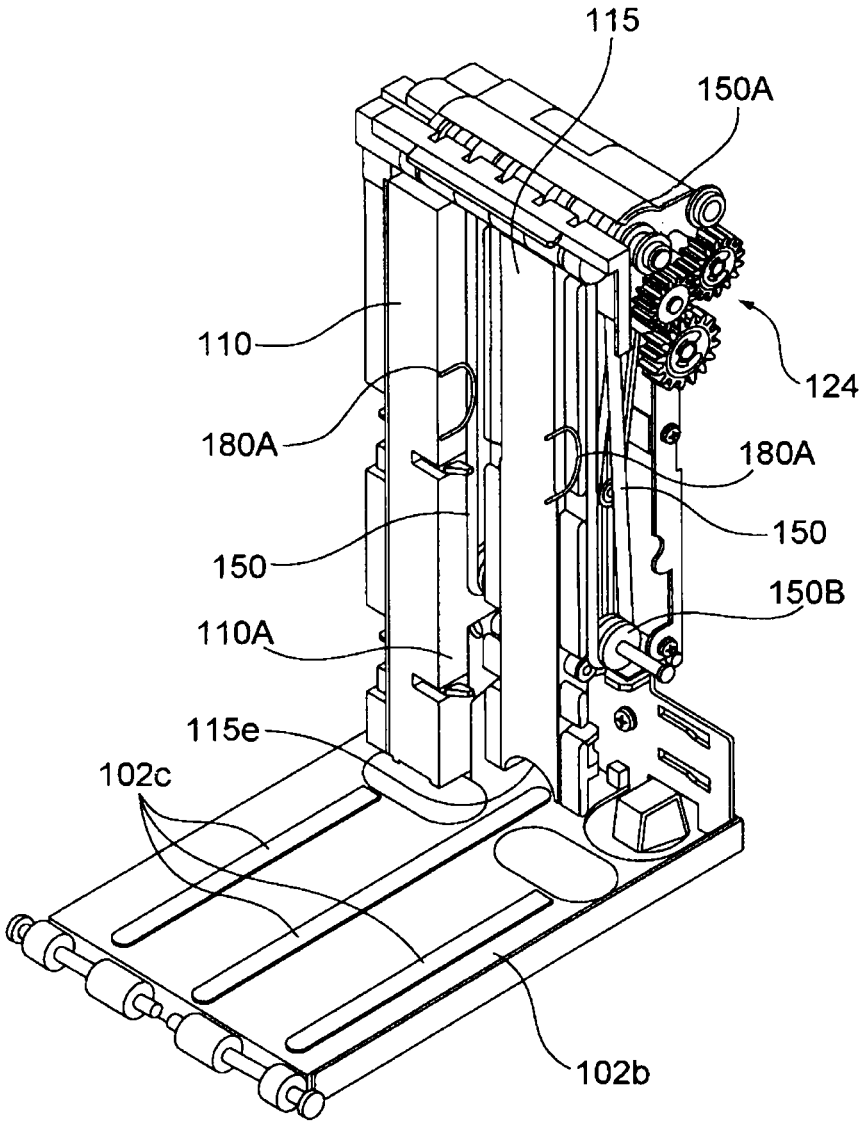
FIG. 24 is a perspective view of a press holding part with surrounding components which holds the bill conveyed-in from the receiving port to stay as it is (some parts are taken away) for illustrating a modified example of the second embodiment.

It is sufficient for the protrusions 180 described above to be configured to be elastically deformable when the bill passes through between those, and the protrusions 180 may be, not only formed to be plate-like, but also appropriately modified. For example, protrusions 180A shown in FIG. 24 are formed of an elastically deformable material such as rubber into a semi-ring shape, and the circular arc portions of the protrusions 180A are attached to the opposite faces 110*d* of the pair of regulatory blocks 110 so as to protrude toward the press holding part side.

In such a structure, after the bill passes through the space 110A between the pair of regulatory blocks 110 and the protrusions 180A are elastically deformed, the protrusions 180A are easy to return to the original state.

Further, with respect to the protrusions 180 and 180A, the attaching portions with respect to the opposite faces 110*d* may be formed of rubber or the like, and the portions protruding from the opposite faces 110*d* to the belt side may be formed of the Mylar® PET film described above or the like. With this configuration, it is possible to make it difficult to bring a plastic deformation to those after the protrusions are elastically deformed.

Next, yet another embodiment of the present invention will be described.

Figure 25:
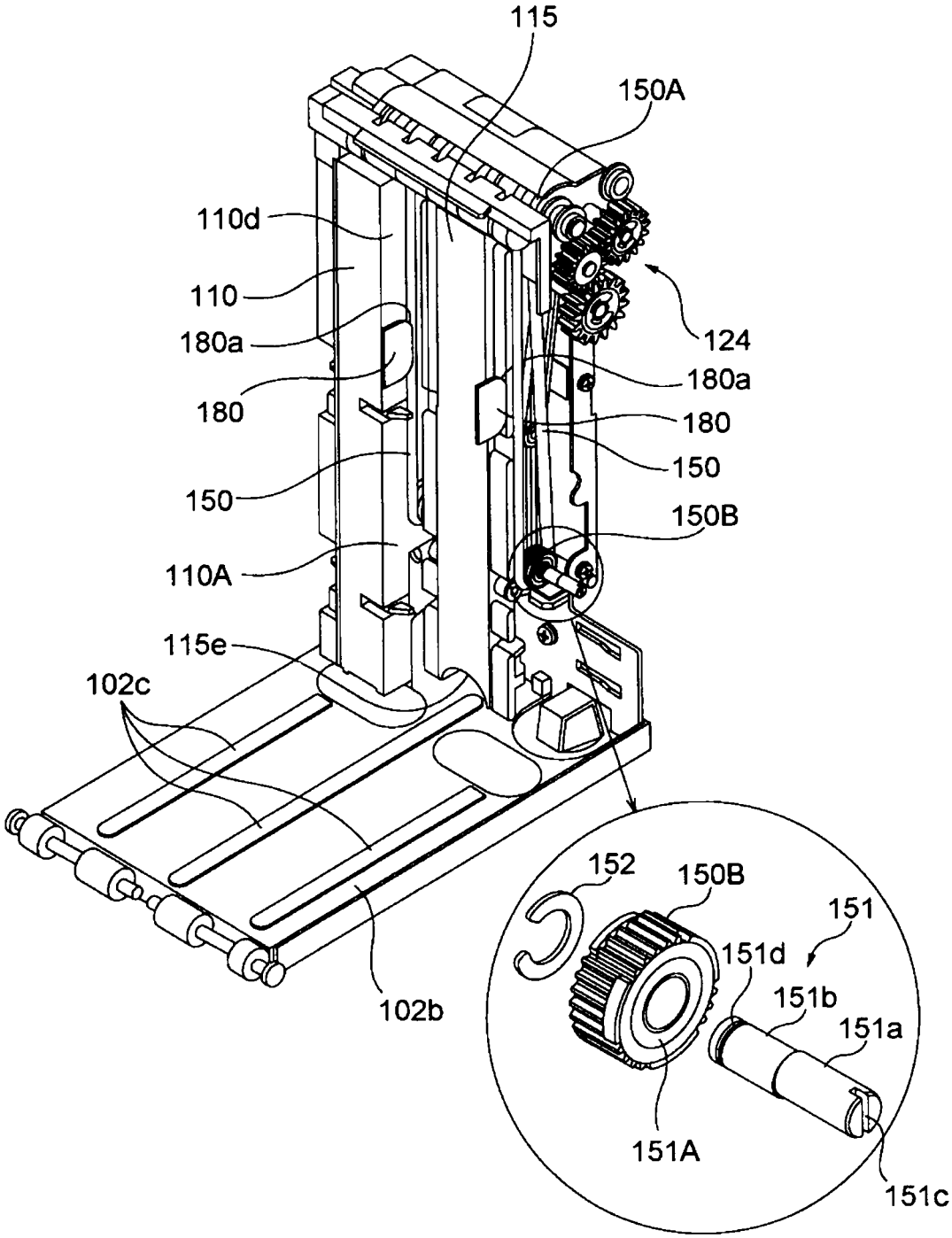
FIG. 25 is a perspective view of a press holding part with surrounding components which holds the bill conveyed-in from the receiving port to stay as it is (some parts are taken away) for illustrating a modified example of the third embodiment.
Figure 26A:
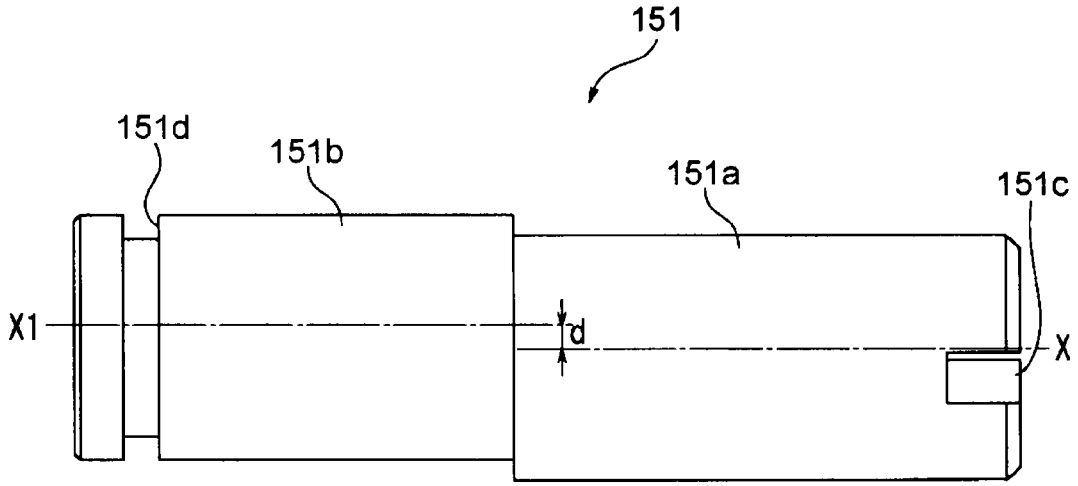
FIG. 26A is a view showing a state in which tension of a belt is loosened to the maximum in accordance with a configuration of a spindle supporting a pulley a belt is wrapped around as shown in FIG. 25.
Figure 26B:
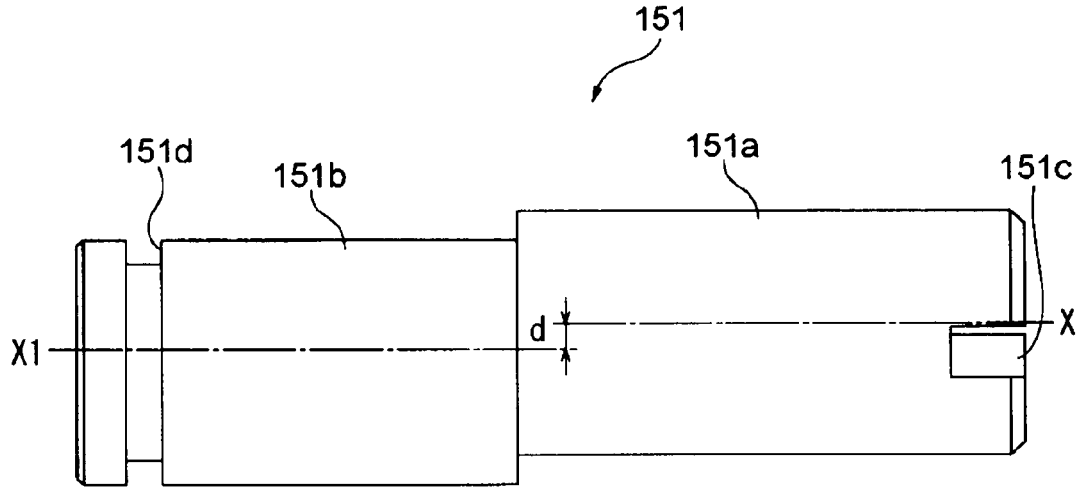
FIG. 26B is a view showing a state of the highest tension of the belt in accordance with a configuration of a spindle supporting a pulley a belt is wrapped around as shown in FIG. 25.
Figure 27A:
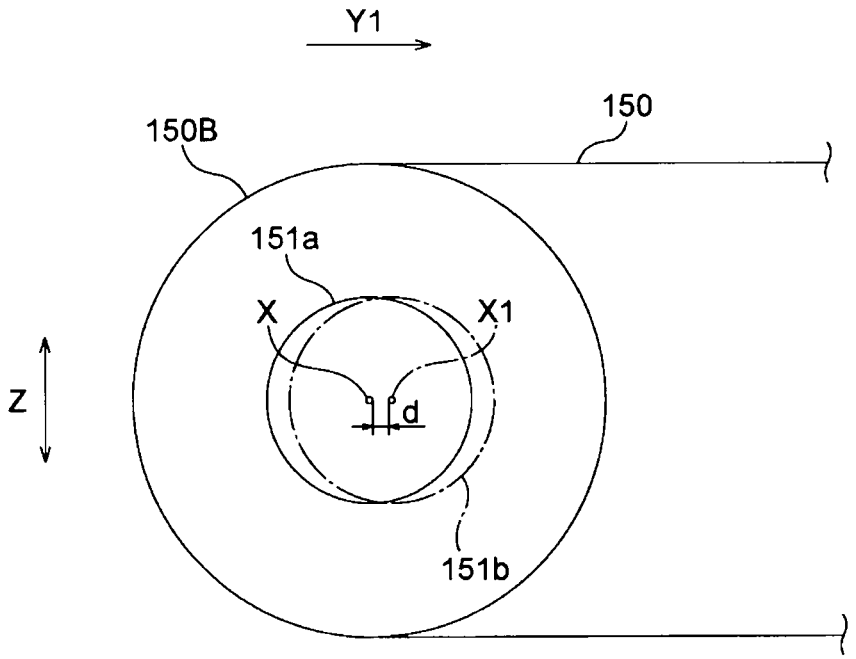
FIG. 27A is a view showing a schematic diagram of a spindle supporting a pulley a belt is wrapped around in a state where tension of the belt is loose.
Figure 27B:
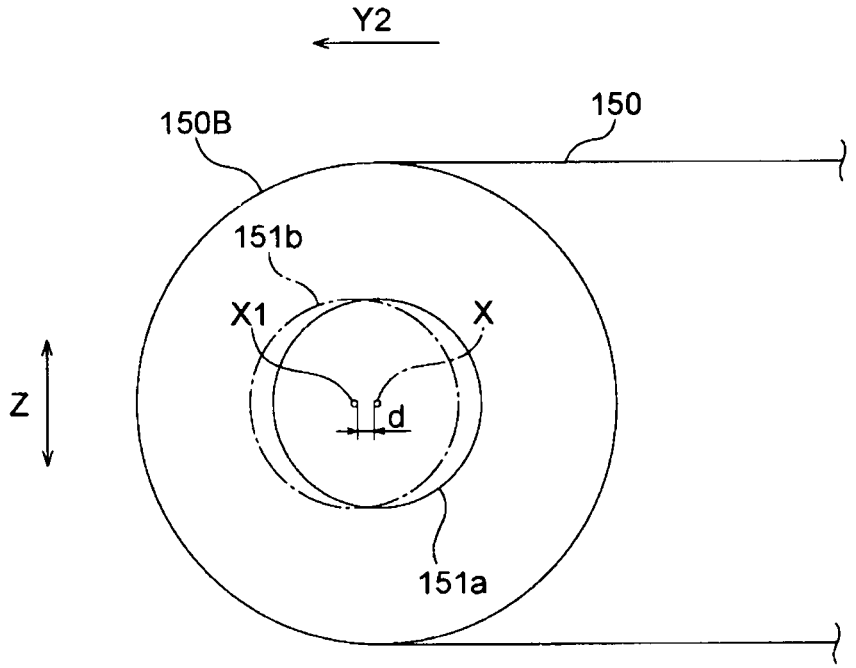
FIG. 27B is a view showing a schematic diagram of a spindle supporting a pulley a belt is wrapped around in a state where tension of the belt is high.

FIGS. 25 to 27 are diagrams showing a third embodiment of the present invention. FIG. 25 is a perspective view of the press holding part and surrounding components that holds the bill conveyed-in from the receiving port to wait (some components are taken away) as it is, FIG. 26 is a view showing the structure of the spindle supporting the pulleys on which the belts are wrapped around in the configuration shown in FIG. 25, FIG. 26A is a view showing a state in which the tension of the belt is loosened to a maximum, and FIG. 26B is a view showing a state of the highest tension of the belt, and FIG. 27 is a schematic diagram of the spindle supporting the pulleys on which the belts are wrapped around in a side view, FIG. 27A is a view showing a state in which the tension of the belt is loosened to a maximum, and FIG. 27B is a view showing a state in which the tension of the belt is tensioned to a maximum.

In the above-described embodiment, the pair of belts 150 forming the conveyor members installed so as to face the press holding part 108 serves to contact the bill to be conveyed in to guide it to the appropriate position as described above.

In this case, the pair of belts 150 wrapped around the pulleys 150A and 150B brings a situation in which the tensions of the respective belts are not even due to a manufacturing error therein or the like. That is, even when the pair of belts 150 are respectively wrapped around the respective pulleys 150A and 150B, unevenness of the lengths at the time of manufacturing those brings a state in which the tensions of the both are not even, and as a result, contact force at the time of touching the bill to be conveyed in may change into skew.

In particular, as described in detail in the second embodiment, because a distance from the point at which the bill passes through the conveyor roller 150C described above up to the bottom face, within which the bill is in a free state, is made long when a bill with a short length is used, if the respective tensions of the pair of belts 150 are different from one another, the contact at the both sides easily becomes unstable, which makes it easy to bring skew in the free state.

Therefore, in the present embodiment, with respect to the pulleys 150A and 150B on which the respective belts 150 are wrapped around, the one pulleys 150B are respectively supported to be independently movable toward the bill housing part 100 (main body frame 10A), which makes it possible to adjust a center distance between the pulleys 150A and 150B, and in accordance therewith, the tensions of the respective belts 150 wound around the pulleys 150A and 150B can be adjusted.

Here, a specific configuration for adjusting the tensions of the belts by moving the pulleys 150B will be described. Here, in FIG. 25, the pulley 150B installed in the front side is illustrated so as to be enlarged. However, the pulley installed in the back side (not shown) as well has the same configuration to be movable.

The spindle 151 supporting the pulley 150B is supported to be rotatable by a transition fit to the bill housing part 100 (main body frame 100A). In detail, the spindle 151 is supported so as to be slightly pressed into the main body frame 100A, and is not moved even if an impact is applied thereto from the outside. However, the spindle 151 is supported so as to be rotatable by an external operation, for example, an operation by using a jig as follows. The spindle 151 of the present embodiment is constituted of a center shaft (mounting shaft) 151*b* on which the pulley 150B is mounted and an eccentric shaft 151*a* operated to rotate by a jig such as a straight slot screwdriver. Therefore, a radial slot 151*c* into which the jig is inserted is formed in the end face of the eccentric shaft 151*a*.

The eccentric shaft 151*a* is formed integrally with the center shaft 151*b* such that a shaft center X is decentered by a predetermined amount (for example, d=0.3 mm) with respect to a shaft center X1 of the center shaft 151*b*, and a bearing 151A is provided on the center shaft 151*b* to support the pulley 150B to be rotatable. Here, a circumferential slot 151*d* is formed in the end of the center shaft 151*b*, and a snap ring 152 is installed thereon to support so as to retain the pulley 150B and the bearing 151A.

As a result, as shown in FIGS. 26A and 27A, in a state in which the center shaft 151*b* is located at the pulley 150A (not shown) side to the maximum, i.e., when the shaft center X1 of the center shaft 151*b* is shifted by the eccentric distance d in a direction of Y1 in the drawing from the shaft center X of the eccentric shaft 151*a*, a center distance between the pulley 150B and the pulley 150A is shortened, which makes it possible to loosen the tension of the belt 150.

Further, as shown in FIGS. 26B and 27B, in a state in which the eccentric shaft 151*a* is made to rotate by 180° from the state of FIGS. 26A and 27A, and the center shaft 151*b* is separated from the pulley 150A (not shown) to the maximum, i.e., when the shaft center X1 of the center shaft 151*b* is shifted by the eccentric distance d in a direction of Y2 in the drawing from the shaft center X of the eccentric shaft 151*a*, a center distance between the pulley 150B and the pulley 150A is stretched, which makes it possible to increase the tension of the belt 150. In the present embodiment, as described above, because the eccentric distance d is set to 0.3 mm, the pulley 150B can be adjusted within a range of ±0.3 mm with respect to the pulley 150A.

Here, in a state in which the eccentric shaft 151*a* is made to rotate by 90° from the state shown in FIGS. 27A and 27B, the tension adjustment of the belt 150 is at the intermediate position. At this time, the pulley 150B is to shift in a direction of Z as well in FIG. 27 (vertically shifts up to ±0.3 mm centering on the shaft center X). However, at the time of adjusting the tension of the belt 150, even if the pulley 150B shifts in the direction of Z, its distance is extremely small as compared with a distance between the pulleys 150A and 150B, which does not have any effect on the contact force to the bill to be conveyed in.

Further, in the present embodiment, the position of the pulley 150B is to be adjusted by operating the above-described eccentric shaft 151*a* to rotate, and because the relationship between an angle of the rotating operation of the eccentric shaft 151*a* and a movement of the pulley 150B draws a track along a sine curve, it is possible to perform a tension adjustment finer than a structure in which the spindle 151 is simply made to come close to or be separated from the spindle of the pulley 150A.

For example, an adjustment of the tension of the belt 150 can be achieved such that predetermined load is applied to a predetermined position of the wrapped belt to measure its flexible volume, and the eccentric shaft 151*a* is operated to rotate while checking the flexible volume. Or, an adjustment of the tension of the belt 150 may be achieved such that the eccentric shaft 151*a* is operated to rotate while the belt 150 is flipped to measure its characteristic frequency.

With the above-described structure, it is possible to adjust the tension of each belt 150, which makes it possible to adjust it to an appropriate tension even if there is an error in the length at the time of manufacturing the belt, and a bill conveyed in via the receiving port can be made to contact the belts 150 coming to be equalized symmetrically. That is, the tensions of the belts 150 on both sides are adjusted to be equalized, which makes it possible to effectively prevent the occurrence skew of the bill.

Further, in the present embodiment, the pulley 150B is supported to the spindle 151 comprising the center shaft 151*b* pivotally supporting the pulley 150B and the eccentric shaft 151*a* decentered with respect to the center shaft 151*b*, and the pulley 150B is to be moved along with the center shaft 151*b* by merely operating the eccentric shaft 151*a* to rotate. That is, because it is possible to shift the position of the center shaft 151*b* of the pulley 150B to easily adjust the tension of the belt 150 to an appropriate state by merely operating the eccentric shaft 151*a* to rotate, there is no need to, for example, install tension pulleys separately, or install springs and the like to change the tensions of the belts, which makes it possible to effectively use the space.

Here, in the present embodiment, as shown in FIG. 25, the protrusions 180 used in the above-described second embodiment are installed. However, the present embodiment may have a configuration in which the protrusions 180 are not installed. Further, the spindle 151 may be supported to be movable along the belt 150 without providing the eccentric shaft 151*a* as described above.

The embodiments of the present invention have been described above. However, the present invention is not limited to the above-described embodiments, and various modifications can be implemented.

The conveyor members installed in the bill housing part 100 of the bill processing apparatus in the above-described embodiments are constituted of the pair of belts 150 contacting the surface of both sides of the bill. However, the conveyor members contacting the bill to be driven in its feeding direction may be members such as rollers that rotate to move so as to contact the bill. Further, the belts 150 are provided as a pair. However, only one belt may be provided.

Moreover, as described above, the driving source that drives the various types of driving members or the mechanism for transmitting power from the driving source have been merely shown as one example, and modifications thereof are appropriately made.

The bill processing apparatus of the present invention can be incorporated into various types of apparatuses providing products and services by inserting a bill thereinto, for example.

Further, the following embodiment is also included.

In a bill processing apparatus including a bill housing stacker as described above, a bill passing through a pair of conveyor rollers installed in the apparatus main body is to be transferred to the bill housing stacker. In this case, even if the bill can pass through a bill receiving port of the bill housing stacker, the bill is thereafter conveyed toward a pressing process position as a width position thereof may fluctuate. In accordance therewith, the bill may stop so as to be shifted in its width direction at the pressing process position, and when the presser plate is driven thereafter, the bill may not be properly placed on the stack part (or placing plate).

A bill processing apparatus capable of reliably housing bills in a bill housing part is provided.

A bill processing apparatus comprises a bill housing part capable of housing a bill therein and a bill conveyance mechanism that conveys the bill to the bill housing part. And in the bill processing apparatus, the bill housing part comprises a receiving port that accepts the bill conveyed by the bill conveyance mechanism and conveyor members which are capable of contacting the bill conveyed-in from the receiving port, and are driven along a conveying-in direction.

In accordance with the bill processing apparatus having the above-described configuration, when a bill is inserted thereinto, the bill is identified as being valid in, for example, a bill identification part, to be conveyed to a bill housing part installed on the downstream side therefrom. Because the bill is conveyed in the bill housing part to contact the conveyor members driven along the conveying-in direction, even if the bill is wrinkled or the like, the bill is conveyed to an appropriate position (a pressing process position).

Further, the conveyor members have a belt and a pulley which are located at the end of the conveying-in direction wherein the belt is wrapped around the pulley.

In such a configuration, a bill may be conveyed in an inclined state because of a positional difference in dragging force by the friction with a pair of conveyor rollers. However, such an inclined conveyance may be prevented by installing a belt. Further, because the belt and pulley can contact the bill along the conveying-in direction, it is possible to reduce the cost as compared with a configuration having a plurality of conveyor rollers and driving sources.

Further, the belt is installed so as to be capable of contacting a surface on left and right sides of the bill.

In such a configuration, the bill conveyed in the inside of the bill housing part slidingly contacts the belt installed so as to be capable of contacting the surface on both sides so as to make it possible to more stably convey the bill to an appropriate position.

Further, the belt is driven by a driving source that drives the bill conveyance mechanism.

In such a configuration, because the driving source for the bill conveyance mechanism is utilized at the time of driving the belt, it is possible to reduce the cost.

Further, the pulley is supported to be movable to the bill housing part so as to be capable of adjusting tension of the belt wrapped around the pulley.

In such a configuration, because the tension of the belt can be adjusted, it is possible to adjust the tension to an appropriate one even if there are differences in the lengths when the belts are manufactured. Therefore, it is possible to reliably convey the bill via the receiving port so as to cause the bill to contact the belt. In particular, when the belts are configured to be capable of contacting the left and right sides of the bill, the tensions of the belts contacting the respective sides are equalized, which makes it possible to effectively prevent the occurrence of skew.

Further, the conveyor member includes a center shaft pivotally supporting the pulley and an eccentric shaft decentered from the center shaft, and the conveyor member operates the eccentric shaft to rotate to move the pulley along with the center shaft.

In such a configuration, a position of the center shaft of the pulley can be shifted only by rotating the eccentric shaft, which makes it possible to easily adjust the tension of the belt to be in an appropriate state.

Further, the bill housing part has guide members regulating both side edges of the bill along the conveying-in direction of the bill.

In such a configuration, when the bill is conveyed in the inside of the bill housing part, the bill can be moved along the guide members, and the bill and the conveyor members can slidingly contact stably, which prevents an inclination from occurring when the bill is conveyed in the bill housing part, and the bill is to be conveyed to an appropriate position.

Further, the bill housing part has a placing member on which bills conveyed-in from the receiving port are stacked to be placed, and a presser plate that presses the bills onto the placing member, and an end face of the presser plate pressing the bills onto the placing member and a bottom face of the bill housing part which the end portion slidingly contacts touch each other so as to have a non-contact portion.

In such a configuration, when the presser plate is driven so as to press the bills onto the placing member, because there is a non-contact portion between the presser plate and the bottom face (for example, a contact relationship due to recess and projection), when the presser plate moves, the bills are prevented from being bitten between the both, which makes it possible to effectively prevent the bills from being jammed inside that bill housing part.

Further, the bill housing part is provided on the opposite side of the conveyor members across the bill to be conveyed-in from the receiving port, and has protrusions protruding toward the conveyor member side.

In such a configuration, the bill to be conveyed-in via the receiving port can be made to reliably contact the conveyor members in a driving state with the protrusions, which makes it possible to cause the bill and the conveyor members to slidingly contact each other. Therefore, it is possible to prevent an inclination of the bill to be conveyed-in from the receiving port from occurring regardless of a size or a state (the presence of wrinkles) of the bill, which makes it possible to finally stack the bill to an appropriate position.

Further, the protrusions have a plate-like shape along a direction perpendicular to the bill conveyed-in from the receiving port, and when the bill is transferred in the direction perpendicular to the conveying-in direction from the receiving port, the protrusions are capable of being deformed by contacting the bill.

In such a configuration, because the protrusions are formed into a plate-like shape, strength to an extent that the protrusions themselves are not deformed can be provided thereto even if load is applied thereto by the bill conveyed-in from the receiving port, which makes it possible to cause the bill to shift toward the conveyor member side to reliably contact the conveyor members. Then, when the bill is finally transferred to its housing position, because the bill contacts the protrusions to be capable of being deformed, the possibility that the bill is damaged is reduced.

In accordance with the present invention, it is possible to provide a bill processing apparatus capable of reliably housing bills in a bill housing part.

What is claimed is:

1. A bill processing apparatus comprising:

a bill housing part which houses a bill; and a bill conveyance mechanism which conveys the bill to the bill housing part, wherein the bill housing part includes a receiving port which accepts the bill conveyed to the bill housing part by the bill conveyance mechanism, a pair of spaced-apart regulatory blocks having opposing surfaces that face each other across a space defined between the regulatory blocks, a presser plate which presses the bill, once it has been conveyed into the bill housing part from the receiving port, through the space between the pair of regulatory blocks, the presser plate being caused to reciprocate by means of a rack-and-pinion-driven presser plate drive mechanism, a conveyor member which contacts a surface of the bill as the bill is conveyed into the bill housing part from the receiving port and which conveyor member is driven along a housing-conveying-in direction, the conveyor member including a pair of belts disposed in opposing relation to respective ones of the regulatory blocks such that edge portions of the bill will be positioned between respective ones of the pair of belts and the pair of regulatory blocks once the bill has been conveyed into the bill housing part from the receiving port, and protrusions which are arranged on respective opposing surfaces of the pair of regulatory blocks and protruding toward respective ones of the pair of belts to push the edge portions of the conveyed-in bill toward the pair of belts, thereby facilitating contact between the edge portions of the conveyed-in bill and respective ones of the pair of belts.

2. The bill processing apparatus according to claim 1, wherein the pair of belts are driven by a driving source that drives the bill conveyance mechanism.

3. The bill processing apparatus according to claim 1, wherein the bill housing part includes guide members regulating both side edges of the bill along the conveying-in direction.

4. The bill processing apparatus according to claim 1, wherein the bill housing part includes a placing member on which bills conveyed in from the receiving port are stacked, the presser plate being configured to press the bills onto the placing member, and the bill housing part has a bottom face which slidingly contacts a bottom end face of the presser plate.

5. The bill processing apparatus according to claim 1, wherein the bill housing part includes a placing member on which bills conveyed in from the receiving port are stacked, the bill housing part has a bottom face which slidingly contacts a bottom end face of the presser plate, and the pair of regulatory blocks have opposing surfaces facing the pair of belts, respectively, and wall surfaces provided on back sides of the regulatory blocks such that bills are stacked between the wall surfaces and the placing member.

6. The bill processing apparatus according to claim 1, wherein each of the protrusions is elastically deformable and plate-shaped, with each of the protrusions being perpendicular to the surface of the bill when it is conveyed in from the receiving port.

7. The bill processing apparatus according to claim 1, wherein the bill conveyance mechanism occupies space in a main body portion of the bill processing apparatus and the bill housing part detachably connects to the main body portion of the bill processing apparatus.

8. The bill processing apparatus according to claim 7, wherein the presser plate drive mechanism comprises a pinion that engages with and is driven by the bill conveyance mechanism when the bill housing part is connected to the main body portion of the bill processing apparatus.

9. The bill processing apparatus according to claim 1, wherein the protrusions comprise flexible, plate-shaped members.

10. The bill processing apparatus according to claim 9, wherein the protrusions extend in a direction perpendicular to the housing-conveying-in direction and the protrusions are flexible so as to deform when the bill is pushed by the presser plate into the bill housing part and then return to their original configuration afterward, thereby alleviating damage to the bill caused by the protrusions.

11. The bill processing apparatus according to claim 1, wherein the conveyor member includes pulleys around which one of the pair of belts is wrapped, with one of the pulleys being movably supported in the bill housing part to adjust tension of the one belt, a center shaft pivotally supporting said one of the pulleys, and an eccentric shaft that is decentered from the center shaft, with the eccentric shaft being configured to rotate to move said one of the pulleys along with the center shaft so as to change a distance between the pulleys.

12. The bill processing apparatus according to claim 11, wherein a center shaft of the one of the pulleys is supported in a radially movable manner in the bill housing part to adjust tension of the respective belts.

13. The bill processing apparatus according to claim 11, wherein an end of the eccentric shaft is abuttingly coupled with an end of the center shaft.

* * * * *